US009339158B2

(12) United States Patent
Dorra

(10) Patent No.: US 9,339,158 B2
(45) Date of Patent: May 17, 2016

(54) AUTO CLEANING TOILET SEAT AND METHOD OF USE

(71) Applicant: Maximo Dorra, Sunny Isles Beach, FL (US)

(72) Inventor: Maximo Dorra, Sunny Isles Beach, FL (US)

( * ) Notice: Subject to any disclaimer, the term of this patent is extended or adjusted under 35 U.S.C. 154(b) by 0 days.

(21) Appl. No.: 14/164,929

(22) Filed: Jan. 27, 2014

(65) Prior Publication Data

US 2014/0137318 A1 May 22, 2014

Related U.S. Application Data

(63) Continuation-in-part of application No. 14/007,893, filed as application No. PCT/US2012/042269 on Jun. 13, 2012, now Pat. No. 9,049,970, which is a continuation of application No. 13/253,197, filed on Oct. 5, 2011, now Pat. No. 8,365,317, which is a continuation-in-part of application No. 12/823,873, filed on Jun. 25, 2010, now Pat. No. 8,060,953, application No. 14/164,929, which is a continuation-in-part of application No. 13/863,601, filed on Apr. 16, 2013, now Pat. No. 8,776,278.

(51) Int. Cl.

| | |
|---|---|
| ***A47K 13/00*** | (2006.01) |
| ***A47K 13/30*** | (2006.01) |
| ***E03D 9/08*** | (2006.01) |
| ***E03D 9/00*** | (2006.01) |

(52) U.S. Cl.

CPC ..... *A47K 13/302* (2013.01); *E03D 9/002* (2013.01); *E03D 9/08* (2013.01)

(58) Field of Classification Search

CPC ..... A47K 13/302

USPC ..... 4/233, 237

See application file for complete search history.

(56) References Cited

U.S. PATENT DOCUMENTS

| | | | | |
|---|---|---|---|---|
| 3,484,876 | A * | 12/1969 | Thomas | 4/234 |
| 5,022,098 | A * | 6/1991 | Brower | 4/233 |
| 6,772,451 | B2 * | 8/2004 | Pellati | 4/233 |
| 2008/0134420 | A1 * | 6/2008 | Ho | 4/233 |

FOREIGN PATENT DOCUMENTS

| | | | | |
|---|---|---|---|---|
| DE | 2233957 | A1 * | 2/1974 | A47K 13/302 |

OTHER PUBLICATIONS

English machine translation for DE 2 233 957 A1.*

* cited by examiner

*Primary Examiner* — Huyen Le
*Assistant Examiner* — Christine Skubinna
(74) *Attorney, Agent, or Firm* — The Concept Law Group, P.A.; Scott D. Smiley; Mark C. Johnson

(57) ABSTRACT

An automatic cleaning toilet seat assembly with a cover surrounding a toilet seat to define a conduit spanning from a back end to a front end of a toilet seat and with a width approximately from the inner circumferential surface to the outer circumferential surface, defining at least one liquid aperture fluidly coupled to a liquid source with a liquid matter, and defining at least one gas aperture in fluid communication with the conduit and fluidly coupled to a gas source with a gaseous matter, the assembly also having an electrical system operable to cause the liquid matter to discharge onto a portion of the toilet seat proximal to the back end of the toilet seat through the at least one liquid aperture and to cause the gaseous matter to discharge through the at least one gas aperture at a speed sufficient to transport the liquid matter through the conduit.

19 Claims, 34 Drawing Sheets

TIME CHARTS

TIME CHARTS

2500

2700

2600

2800

2800 a-a b-b

AUTO CLEANING TOILET SEAT AND METHOD OF USE

CROSS-REFERENCE TO RELATED APPLICATION

This application is a continuation-in-part and claims priority to U.S. application Ser. No. 14/007,893, filed on Sep. 26, 2013, which claims priority to PCT Application No. PCT/US12/42269, filed Jun. 13, 2012, which claims priority to U.S. application Ser. No. 13/253,197, filed on Oct. 5, 2011, now issued as U.S. Pat. No. 8,365,317, which is a continuation-in-part of U.S. application Ser. No. 12/823,873, filed on Jun. 25, 2010, now issued as U.S. Pat. No. 8,060,953; the entirely of these applications and patents are incorporated by reference. This application is also a continuation-in-part and claims priority to U.S. application Ser. No. 13/863,601, filed on Apr. 16, 2013.

FIELD OF THE INVENTION

The present invention relates to toilet systems, and more particularly, to an automatic toilet seat cleaning assembly.

BACKGROUND OF THE INVENTION

There are many other known toilet seat washing assemblies. Most of these assemblies employ the use of numerous components in order function properly. These numerous components require a great deal of user time spent in maintenance and installation. Moreover, many of these assemblies have components that rotate and move when in operation such that they are more susceptible to failure. Not only are these assemblies more susceptible to failure, they are also more expensive and difficult to manipulate for precise control of the assembly during the cleaning process. For example, some known assemblies have rotating arms that clean the toilet seat but these arms are not able to be controlled or optimized to produce various cleaning cycles desirable for a particular user.

Other known assemblies closest to the subject matter of the instant application provide for a number of more or less complicated features that fail to solve the problem in an efficient and economical way. Some known assemblies for automatically cleaning a toilet seat provide multiple discharge locations of liquid and gas, e.g., air, onto a toilet seat, thereby requiring more parts and a more unattractive assembly as it is perceived by the view public. Because of the amount of parts associated with these assemblies, they are generally expensive and require more time/cost to install and to maintain. Moreover, many of those known toilet seat cleaning devices utilize complex and expensive mechanical devices to discharge the fluid onto the toilet seat and remove it from the same.

SUMMARY OF THE INVENTION

With the foregoing and other objects in view, there is provided, in accordance with the invention, an automatic cleaning toilet seat assembly that solves the above-described disadvantageous and includes its implementation in connection with a toilet having a toilet seat including a front end, a back end, a top surface, and an inner and an outer circumferential surface. The assembly includes a cover with a first position and a second position along a translation path. The first position includes the cover surrounding the toilet seat to define a conduit spanning from the back end of the toilet seat to the front end of the toilet seat and with a width spanning approximately from the inner circumferential surface to the outer inner circumferential surface. The second position includes the cover removed from above a portion of the toilet seat. The cover defines at least one liquid aperture fluidly coupled, through a fluid channel, to a liquid source with a liquid matter and defines at least one gas aperture in fluid communication with the conduit and fluidly coupled, through a gas channel, to a gas source with a gaseous matter. The assembly also has an electrical system operable to cause (1) the liquid matter to discharge onto a portion of the toilet seat proximal to the back end of the toilet seat through the at least one liquid aperture and (2) the gaseous matter to discharge through the at least one gas aperture at a speed sufficient to transport the liquid matter through the conduit, when the cover is in the first position. This embodiments provides an efficient and effective cleaning process that conserves energy and minimizes the maintenance and installation of an automatic cleaning assembly.

In accordance with a feature of the present invention, the liquid matter is of at least partially a disinfectant agent.

In accordance with a further feature of the present invention, the speed of the gaseous matter is sufficient to transport the liquid matter from the portion of the toilet seat proximal to the back end of the toilet seat to the front end of the toilet seat.

In accordance with yet another feature of the present invention, the at least one liquid aperture is located proximal to the back end of the toilet seat.

In accordance with an additional feature of the present invention, the at least one gas aperture is located proximal to the back end of the toilet seat.

In accordance with yet another exemplary feature of the present invention, the liquid matter is initially discharged at a point in time during a cleaning cycle subsequent to an initial discharge of the gaseous matter.

In accordance with another feature, an embodiment of the present invention includes the cover having an upper surface of a transparent material.

In accordance with yet another feature, an embodiment of the present invention also includes the electrical system being further operable to cause a plurality of UV lights coupled to the cover to emit, when the cover is in the first position, UV light to at least a portion of the back end, first side, and second side of the toilet seat.

In accordance with an additional feature, an embodiment of the present invention includes the cover having a wall projecting from an inner surface of the cover and dividing the conduit to define a first conduit spanning from the back end to the front end of the toilet seat on a first side of the toilet seat and to define a second conduit spanning from the back end to the front end of the toilet seat on a second side of the toilet seat.

In accordance with another feature, an embodiment of the present invention includes the cover including a plurality of liquid apertures fluidly coupled, through a plurality of fluid channels, to the liquid source and a plurality of gas apertures fluidly coupled, through a plurality of gas channels, to the gas source. The aforementioned electrical system is then operable to cause the liquid matter to discharge through the plurality of liquid apertures onto the portion of the toilet seat proximal to the back end of the toilet seat in the first and second conduits and to cause the gaseous matter to discharge through the plurality of gas apertures at a speed in each of the first and second conduits sufficient to transport the liquid matter from the portion of the toilet seat proximal to the back end of the toilet seat to the front end of the toilet seat. This liquid matter may derive (and its corresponding pressure) from the lines utilized with the building to which the toilet is attached.

In accordance with a further feature of the present invention, the conduit is in a substantially water-tight configuration with the toilet seat when the cover is in the first position.

In accordance with yet another feature, an embodiment of the present invention includes a sensor coupled to the automatic cleaning toilet seat assembly. The sensor is operable to detect movement of a user within a close proximity, wherein the detection of hand movement causes the cover to be placed in the second position.

In accordance with a further feature, the conduit is shaped to follow a contour the inner and the outer circumferential surface of the toilet seat as the toilet seat spans from the back end of the toilet seat to the front end of the toilet seat.

In accordance with an additional feature, an embodiment of the present invention includes a distance separating the top surface of the toilet seat and an upper surface of the cover. The distance separating the top surface of the toilet seat and the upper surface of the cover tapers as the conduit spans from the back end of the toilet seat to the front end of the toilet seat to facilitate air/fluid flow in the conduit.

Another embodiment of the present invention includes a cover shaped to cover a toilet seat. The cover (1) defines a conduit shaped to follow a contour an inner and an outer circumferential surface of the toilet seat as the toilet seat spans from a back end of the toilet seat to a front end of the toilet seat, (2) defines at least one liquid aperture fluidly coupled, through at least one liquid channel, to a liquid source with a liquid matter, with the at least one liquid aperture located proximal to the back end of the toilet seat, and (3) defines at least one gas aperture fluidly coupled, through at least one gas channel, to a gas source with a gaseous matter, with the at least one gas aperture located proximal to the back end of the toilet seat. The cover assembly also has a pump-like device operable to induce of a flow of the liquid matter from the liquid source to the at least one liquid aperture and a fan-like device operable to induce of a flow of the gaseous matter from the gas source to the at least one liquid aperture.

In accordance with another feature of the present invention, the fan-like device operably induces a flow, initially at a point in time during a cleaning cycle, subsequent to when the flow of the gaseous matter is initially induced.

In accordance with the present invention, a method of automatically cleaning a toilet seat. Method includes the steps of providing a cover, a pump-like device, and fan-like device. The cover defines (1) at least one liquid aperture and (2) at least one gas aperture. The next steps include (1) coupling the cover to a toilet seat of a toilet, (2) positioning the cover over the toilet seat to surround the toilet seat and define a conduit with spanning from a back end of the toilet seat to a front end of the toilet seat, (3) discharging a liquid matter through the at least one liquid aperture onto a portion of the toilet seat proximal to the back end of the toilet seat, and (4) discharging a gaseous matter through the at least one gas aperture and through the conduit to transport the liquid matter from the back end of the toilet seat to the front end of the toilet seat. Steps (3) and (4) may be carried out in various times and in various degrees of intensity.

Although the invention is illustrated and described herein as embodied in an automatic cleaning toilet seat assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION

Figure 1:
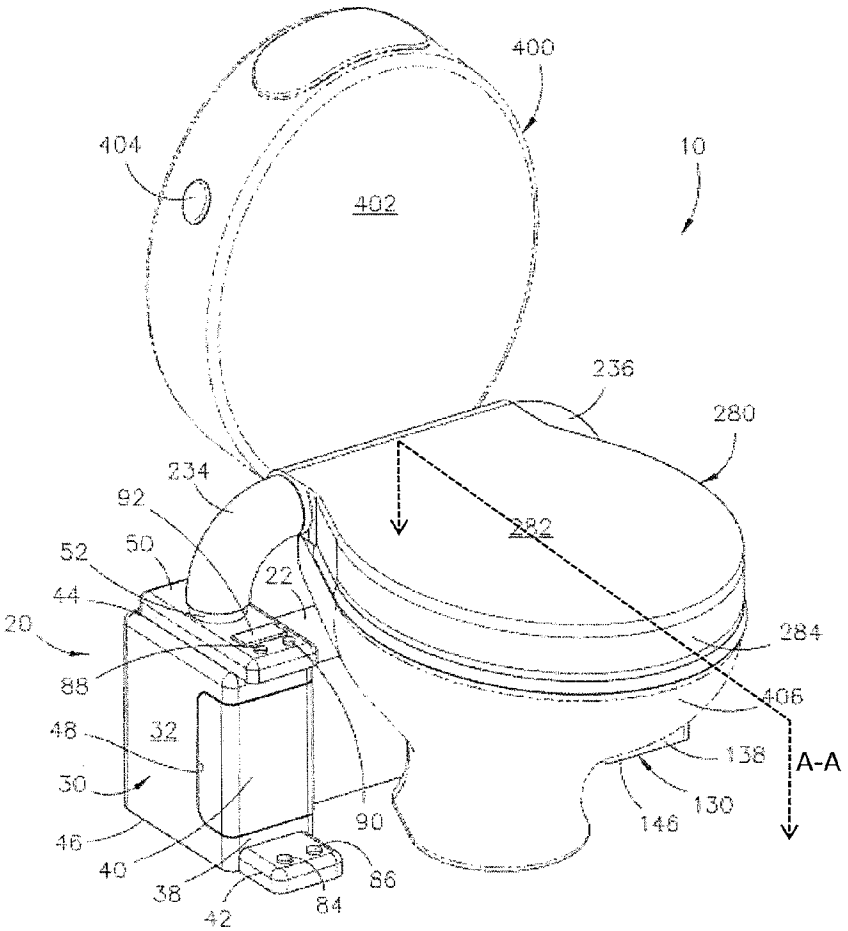
FIG. 1 is an isometric view of a cover assembly in a closed position and installed onto a standard toilet.

It is evident that an invention such as the automatic toilet seat-cleaning system claimed in the present application is quite desirable because it disinfects the toilet seat before use. The claimed invention is also quite desirable because it provides an apparatus that washes and dries the anus and adjacent body opening areas of a user after using a toilet. In addition, the claimed invention can be used in circular and/or oval shape toilet bowls. Furthermore, the claimed invention is volumetrically efficient, of a durable and reliable construction, and it is inexpensive to manufacture and maintain while retaining its effectiveness.

Referring now to the drawings, the present invention is a combined automatic toilet self-cleaning and user hygienic system and is generally referred to with numeral 10. It can be observed that it basically includes housing assembly 20, electrical system 80, liquid matter system 110, turbine assemblies 100 and 200, manifold assembly 220, manifold 240, toilet seat assembly 270, and cover assembly 280.

As seen in FIG. 1, instant invention 10 is mounted to toilet 400, which comprises tank 402 with flush button 404, and toilet bowl 406. Housing assembly 20 comprises bridge 22 connecting tower assemblies 30 and 130 cooperatively mounted at lateral sides of toilet 400. Bridge 22 is preferably positioned behind a base of toilet bowl 406.

Figure 2:
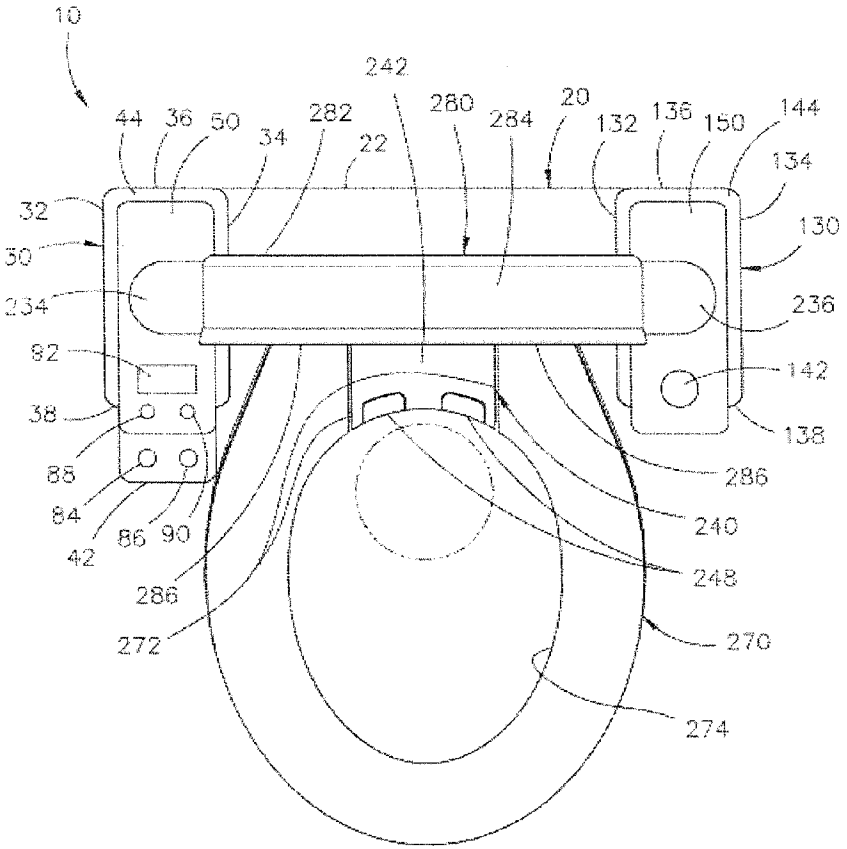
FIG. 2 is a top plan view the cover assembly of FIG. 1 in an open position and installed onto the standard toilet, whereby the tank of the toilet has been removed for illustrative purposes.

As best seen in FIG. 2, tower assembly 30 comprises lateral walls 32 and 34, rear wall 36, front wall 38, base switch housing 42, top wall 44, base 46 as seen in FIG. 1, and top switch housing 50 mounted onto top wall 44. Similarly, tower assembly 130 comprises lateral walls 132 and 134, rear wall 136, front wall 138, pressure regulator 142, top wall 144, base 146 as seen in FIG. 1, and top regulator housing 150 mounted onto top wall 144.

Figure 3:
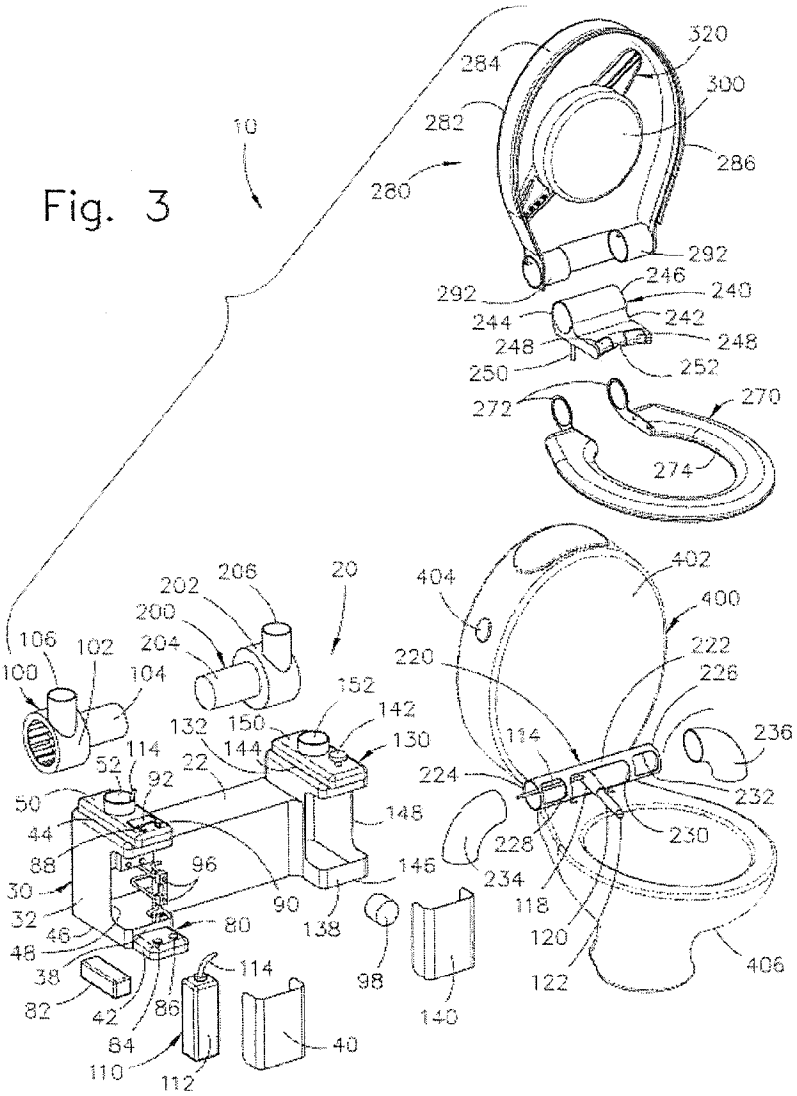
FIG. 3 is an exploded view of the cover assembly of FIG. 1.

As seen in FIG. 3, front wall 38 of tower assembly 30 has front cover panel 40 removably mounted to cutout 48. Conduit 52 extends upwardly from top switch housing 50. Front wall 138 of tower assembly 130 has front cover panel 140 removably mounted to cutout 148. Conduit 152 extends upwardly from top regulator housing 150.

Electrical system 80 comprises control box 82 with switches 84 and 86 disposed at base switch housing 42, and switches 88 and 90 disposed at top switch housing 50. In a preferred embodiment, screen 92 is positioned at top switch housing 50 and functions to give a status of instant invention 10. Electrical system 80 further comprises electrical wiring 94, seen in FIG. 12, electrical valves 96 and impeller pump 98. Pressure regulator 142 is connected to impeller pump 98.

Pressure regulator 142 functions to regulate liquid matter LM pressure exiting bidet base 118 having telescopic section 120, and specifically bidet 122. Such liquid matter LM may be, but is not limited to, water, water combined with other matter such as a chemical, a chemical solution, and/or a chemical solution comprising a disinfectant as an example. The chemical, chemical solution, and/or chemical solution comprising a disinfectant may be of gas, liquid, semi-liquid, semi-solid, or solid matter.

Turbine assembly 100 is housed within tower assembly 30 and comprises housing 102, motor housing 104 and outlet 106. Outlet 106 connects to conduct 52. Similarly, turbine assembly 200 is housed within tower assembly 130 and comprises housing 202, motor housing 204 and outlet 206 that connects to conduit 152.

Figure 12:
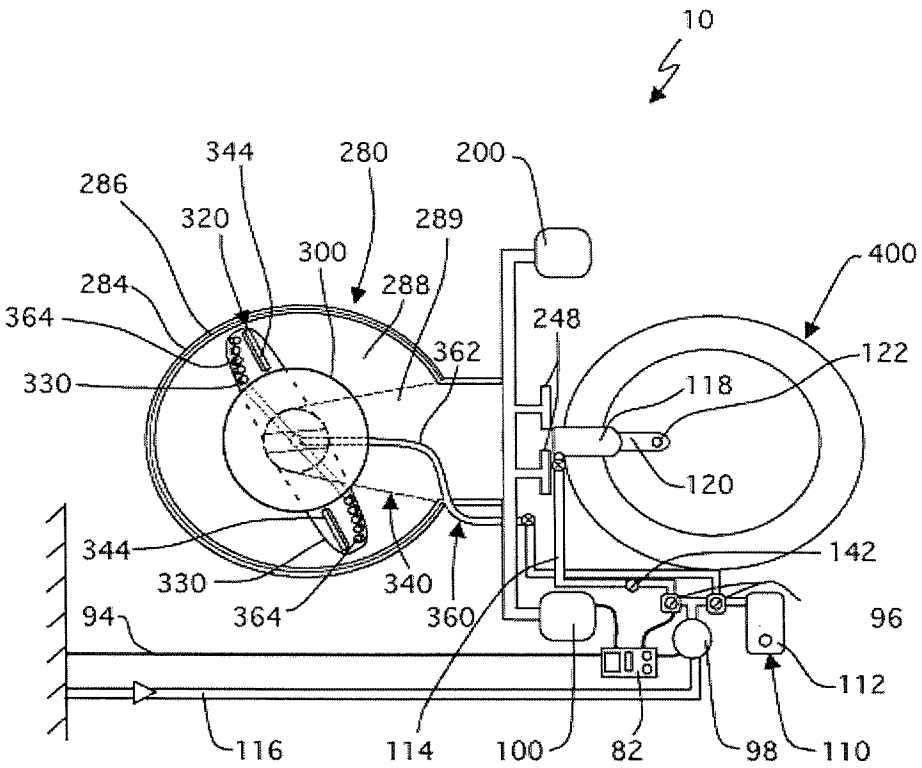
FIG. 12 is a schematic diagram of the cover assembly of FIG. 10.

Liquid matter system 110 includes disinfectant container 112 housed within tower assembly 30, connecting tube 114, and bidet base 118 having telescopic section 120 and bidet 122 at its distal end. Liquid matter system 110 further includes line 116 from a water source, which is best seen in FIG. 12.

As also seen in FIG. 3, manifold assembly 220 has wall 222 with ends 224 and 226, cutouts 228 and 232, and central cutout 230. Manifold assembly 220 further comprises air ducts 234 and 236 that mount to conduits 52 and 152 of top switch housing 50 and top regulator housing 150 respectively. Connecting tube 114 goes through manifold assembly 220. Bidet base 118 with telescopic section 120 is partially housed within manifold assembly 220 and protrudes through central cutout 230.

Manifold 240 is mounted with mounting posts 250 passing through standard openings in toilet bowl 406 used for mounting of traditional toilet seats. Manifold 240 comprises housing 242 with ends 244 and 246. Manifold flaps 248 are cooperatively disposed at a forward section of manifold 240. Manifold flaps 248 have spring-loaded hinges, not seen. Tubular cutout 252 is also at the forward section of manifold 240 between manifold flaps 248.

Toilet seat assembly 270 has mounting brackets 272 and inner edge 274.

Mounting brackets 272 mount to ends 244 and 246 of manifold 240. Mounting frame 292 mounts to mounting brackets 272. It is noted that manifold assembly 220 passes through manifold 240, mounting brackets 272, and mounting frame 292. Proximal ends of air ducts 234 and 236 are mounted to mounting frame 292, which in turn are next to ends 224 and 226 of manifold assembly 220. Bidet base 118 is positioned through central cutout 230 of manifold assembly 220, and through an opening of manifold 240, not shown, to be cooperatively disposed at tubular cutout 252.

It is noted that manifold assembly 220, manifold 240, mounting brackets 272, and mounting frame 292 are on a same axis.

As also seen in FIG. 3, manifold assembly 220 has wall 222 with ends 224 and 226, cutouts 228 and 232, and central cutout 230. Manifold assembly 220 further comprises air ducts 234 and 236 that mount to conduits 52 and 152 of top switch housing 50 and top regulator housing 150 respectively. Connecting tube 114 goes through manifold assembly 220. Bidet base 118 with telescopic section 120 is partially housed within manifold assembly 220 and protrudes through central cutout 230.

Manifold 240 is mounted with mounting posts 250 passing through standard openings in toilet bowl 406 used for mounting of traditional toilet seats. Manifold 240 comprises housing 242 with ends 244 and 246. Manifold flaps 248 are cooperatively disposed at a forward section of manifold 240. Manifold flaps 248 have spring-loaded hinges, not seen. Tubular cutout 252 is also at the forward section of manifold 240 between manifold flaps 248.

Toilet seat assembly 270 has mounting brackets 272 and inner edge 274.

Mounting brackets 272 mount to ends 244 and 246 of manifold 240. Mounting frame 292 mounts to mounting brackets 272. It is noted that manifold assembly 220 passes through manifold 240, mounting brackets 272, and mounting frame 292. Proximal ends of air ducts 234 and 236 are mounted to mounting frame 292, which in turn are next to ends 224 and 226 of manifold assembly 220. Bidet base 118 is positioned through central cutout 230 of manifold assembly 220, and through an opening of manifold 240, not shown, to be cooperatively disposed at tubular cutout 252.

Figure 4:
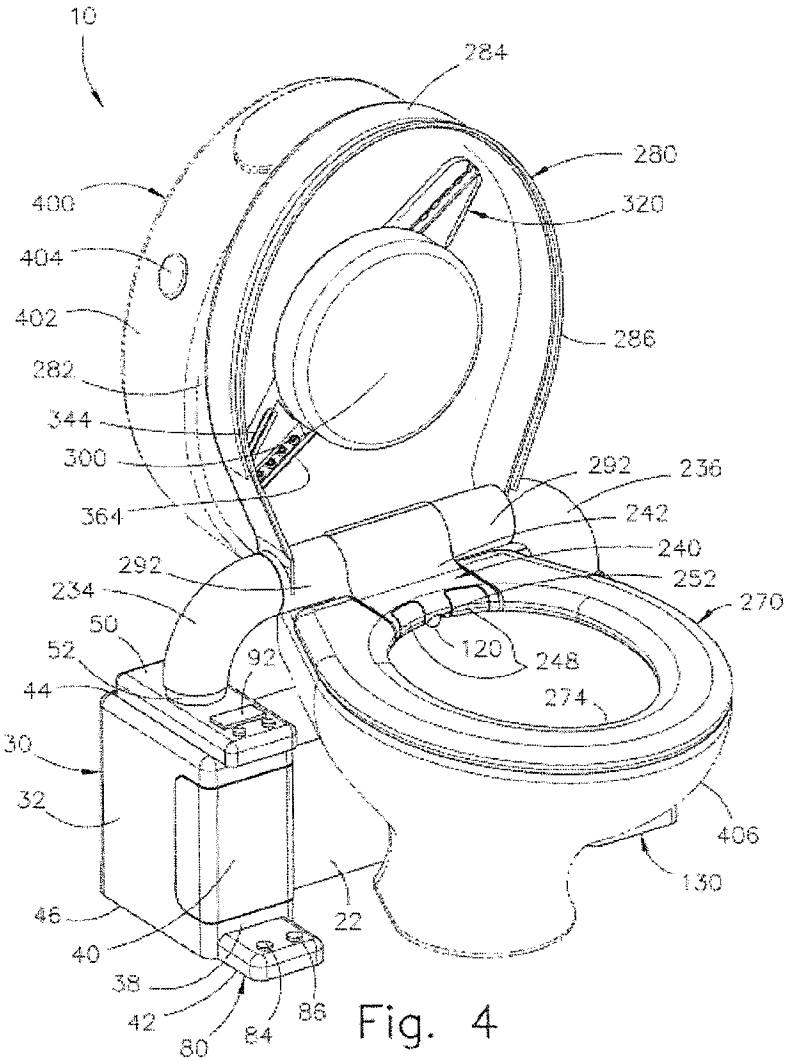
FIG. 4 is an isometric view of the cover assembly of FIG. 1 in an open position and installed onto the standard toilet having a circular toilet bowl.
Figure 5:
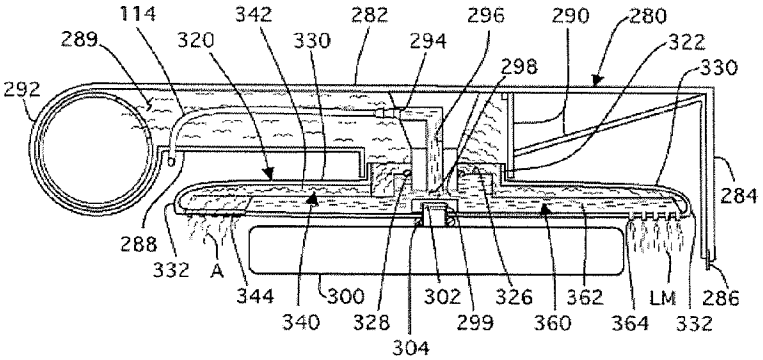
FIG. 5 is a schematic cross section of the cover assembly of FIG. 1 along A-A, showing the liquid matter and air flowing.
Figure 6:
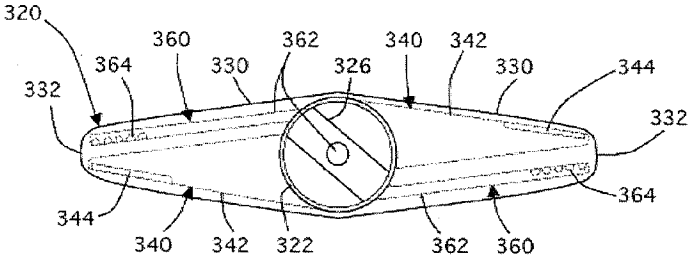
FIG. 6 is a top view of a rotating arm assembly.
Figure 7:
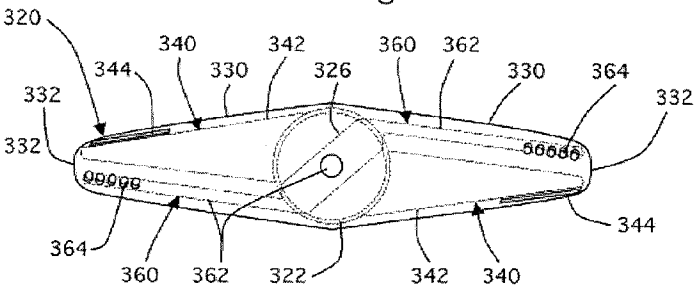
FIG. 7 is a bottom view of the rotating arm assembly of FIG. 6.

It is noted that manifold assembly 220, manifold 240, mounting brackets 272, and mounting frame 292 are on a same axis. As seen in FIGS. 4 and 5, cover assembly 280 comprises exterior wall 282, best seen in FIG. 1, sidewall 284 with edge 286, interior wall 288, structural wall 290, and mounting frame 292. Sidewall 284 fits around toilet seat assembly 270 to force liquid matter to flow into toilet bowl 406. As best seen in FIG. 5, cover assembly 280 also has entry port 294 to connecting tube 114 as an access for liquid matter LM from liquid matter system 110. Entry port 294 extends to channel 296 having holes 298 extending perpendicularly therefrom and hole 299. Alignment assembly 300, having threaded neck 302, secures into hole 299. Spacer 304 keeps rotating arm assembly 320 in place and spaced apart from alignment assembly 300. Spacer 304 is made out of a self-lubricated material, preferably, to facilitate the free movement of rotating arm assembly 320. In an alternate embodiment, neck 302 is not threaded and is forced into hole 298. When cover assembly is in the closed position, alignment assembly 300 aligns interiorly to inner edge 274 of toilet seat assembly 270 leaving a space for liquid matter LM to go through. As seen in FIGS. 5, 6, and 7, cover assembly 280 has mounting frame 292 to mount onto manifold assembly 220. Cover assembly 280 further comprises rotating arm assembly 320. Rotating arm assembly 320 has at least one cutout 344 for air A to flow originating from turbine assemblies 100 and 200. Rotating arm assembly 320 further has at least one cutout 364 for liquid matter LM to exit therefrom that is directed onto toilet seat assembly 270 in a manner so as to provide cleaning of toilet seat assembly 270. As best seen in FIGS. 5 and 6, a section of exterior wall 282 and structural walls 290 define channel 289.

More specifically, rotating arm assembly 320 further has hub 322. Hub 322 fits into interior walls of cover assembly 280, and specifically interior wall 288 and structural walls 290. Rotating arm assembly 320 also has bridge 326 within hub 322 and o-ring 328, or a similar type of sealing member. Bridge 326 connects to liquid matter duct assembly 360. Extending from hub 322 is at least one arm 330 having end 332. In a preferred embodiment, hub 322 has arms 330 extending in opposite directions therefrom. Each arm 330 comprises air duct assembly 340 and liquid matter duct assembly 360. Air duct assembly 340 has air ducts 342 comprising at least one cutout 344 for air A to flow originating from turbine assemblies 100 and 200. Liquid matter duct assembly 360 has liquid matter ducts 362 comprising at least one cutout 364 for liquid matter LM to exit therefrom.

Figure 8A:
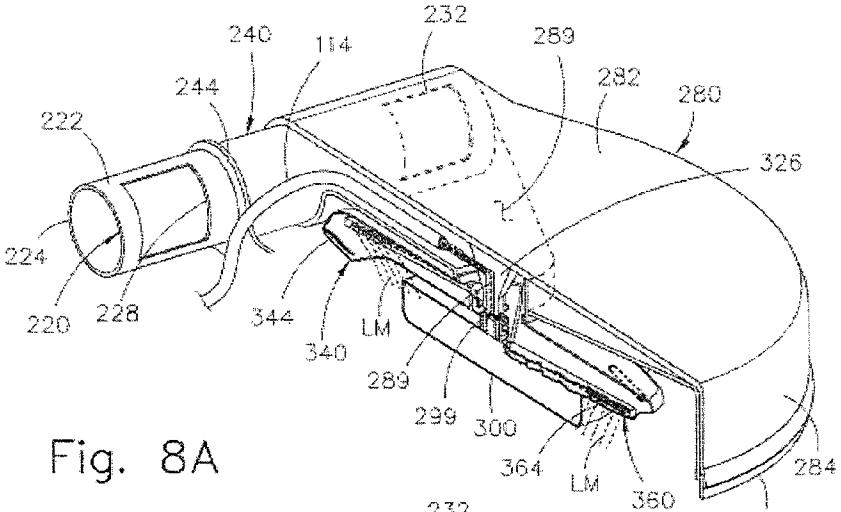
FIG. 8A is a partially sectioned isometric view of the cover assembly of FIG. 1 along A-A in the closed position and showing an activated liquid matter duct assembly.
Figure 8B:
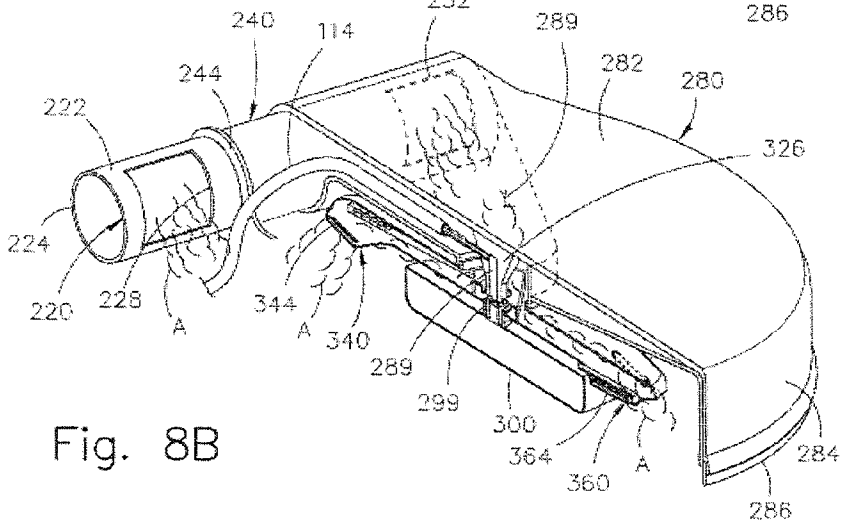
FIG. 8B is a partially sectioned isometric view of the cover assembly of FIG. 1 along A-A in the closed position and showing an activated air duct assembly.

As seen in FIGS. 8A and 8B, cover assembly 280 has been partially cross-sectioned to show how interior parts work. It is noted that when cover assembly 280 is closed, cutouts 228 and channel 289 are aligned thus permitting air A flowing from turbine assemblies 100 and 200 to flow through air duct assembly 340. Also, it is noted that side wall 284 positions around an external edge of toilet seat assembly 270 and alignment assembly 300 cooperatively fits onto inner edge 274, resting upon toilet seat assembly 270 in a way that a there is a clearance between alignment assembly 300 and inner edge 274 at front and sides. However, a rear portion of alignment assembly 300 snugly fits to a front section of manifold 240, thus preventing manifold flaps 248 from opening when cover assembly 280 is closed.

Figure 9A:
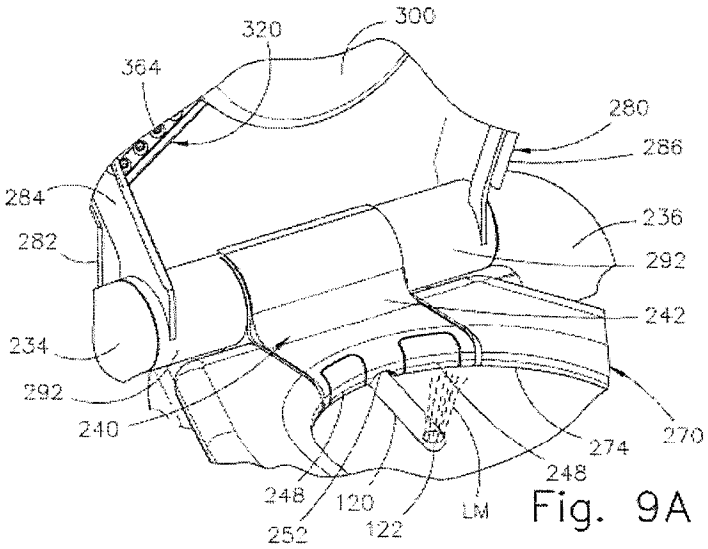
FIG. 9A is a partially sectioned isometric view of a bidet extended and in use.
Figure 9B:
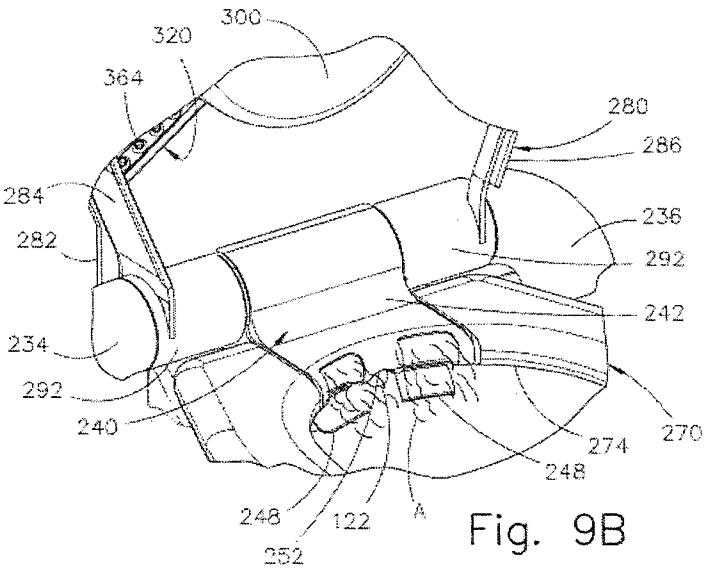
FIG. 9B is a partially sectioned isometric view of the bidet retracted and manifold flaps in an open position, whereby forced air expels therefrom.
Figure 10:
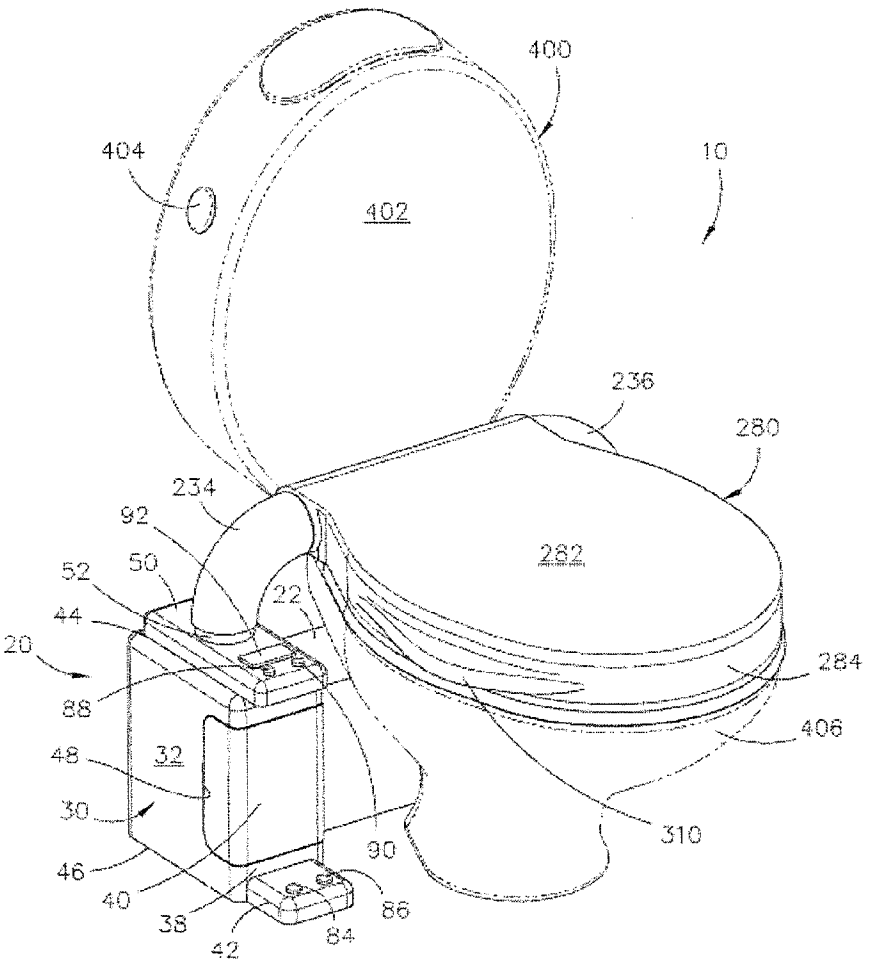
FIG. 10 is an isometric view of an alternate embodiment for a cover assembly with a cover assembly in a closed position and installed onto an oval-shape toilet bowl.
Figure 11:
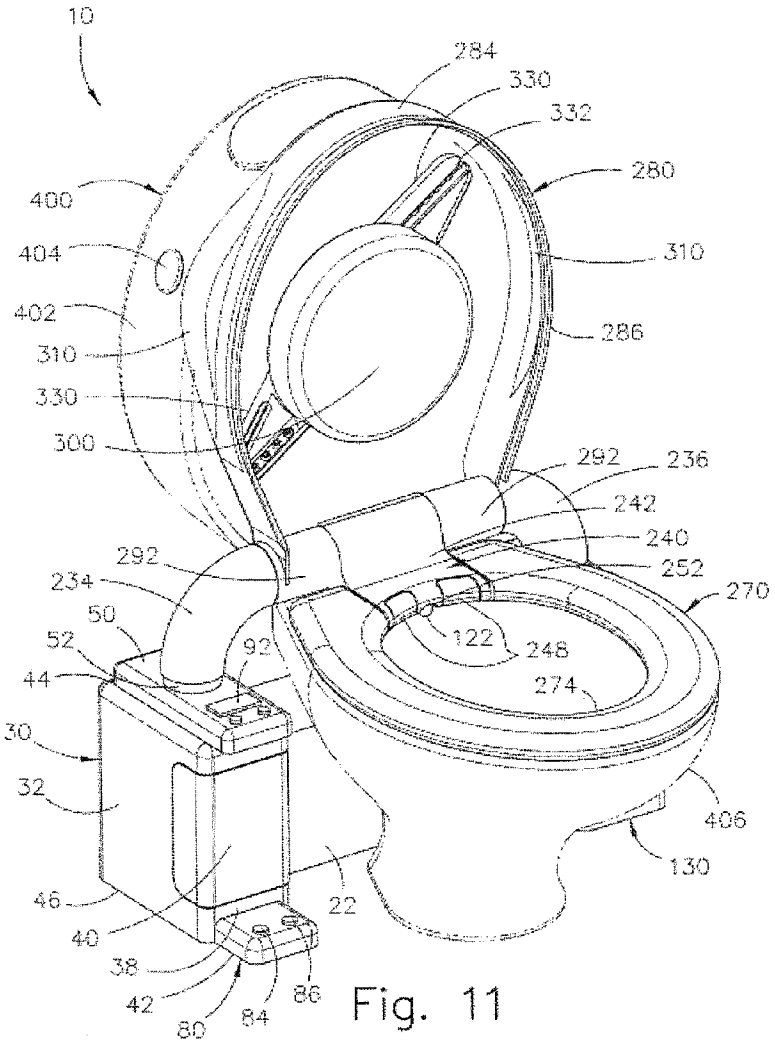
FIG. 11 is an isometric view of the cover assembly of FIG. 10 in an open position and installed onto the standard toilet having the oval shape toilet bowl.

In operation, liquid matter duct assembly 360 is activated with switch 84 or 88, whereby liquid matter LM is delivered through cutouts 364 for a predetermined period of time on to toilet seat assembly 270. The disposition of sidewall 284 and alignment assembly 300 forces the delivered liquid matter LM to be directed inside toilet bowl 406. Once the cycle above has finished a displacing and drying cycle starts. Air A flowing from turbine assemblies 100 and 200 is directed through air ducts 234 and 236, cutouts 228 and 232, and then channel 289 into air duct assembly 340, exiting through cutouts 344 to displace and/or dry the liquid matter LM from the surface of toilet seat assembly 270. Instant invention 10 is then clean, sanitized, and ready for use by a user As seen in FIGS. 9A and 9B, once a user uses toilet 400, especially upon voiding, switch 86 or 90 is pressed to activate an anal cleaning cycle. Impeller pump 98 causes liquid matter LM to be expelled through bidet 122 for a predetermined period of time. The user can regulate the pressure of the liquid matter LM exiting bidet 122 by actuating pressure regulator 142. Liquid matter LM pressure causes telescopic section 120 to extend from bidet base 118. When the anal cleaning cycle ends, telescopic section 120 retracts back in to bidet base 118 and the anal drying cycle starts. Since cover assembly 280 is in an open position, channel 289 is covered by wall 222 of manifold assembly 220. Therefore, air A flowing from turbine assemblies 100 and 200 forces manifold flaps 248 to open. Air A flowing through manifold flaps 248 is directed to the user's anal area for a predetermined period of time. As seen in FIGS. 10 and 11, cover assembly 280 may comprise elongated protrusions 310 as an alternate embodiment. Elongated protrusions 310 are best utilized when toilet bowl 406 has a more oval shape as compared to a more circular shape as illustrated in FIG. 4. In operation, elongated protrusions 310 receive ends 332 of arms 330 as rotating arm assembly rotates therein.

Seen in FIG. 12 is a schematic diagram of the connections for instant invention 10. Water enters from a water source through line 116, having a one-way valve, flows to impeller pump 98. Liquid matter LM flow is selectively directed by electrical valves 96; either to liquid matter duct assembly 360, along with a predetermined amount of disinfectant from disinfectant container 112, or to bidet 122 with a pressure that user determines using pressure regulator 142.

Electrical wiring supplies electrical power to control box 82, which in turn is connected to turbine assemblies 100 and 200, impeller pump 98, and electrical valves 96. Retention valves can be conveniently disposed to control the direction of the water flow.

Figure 13:
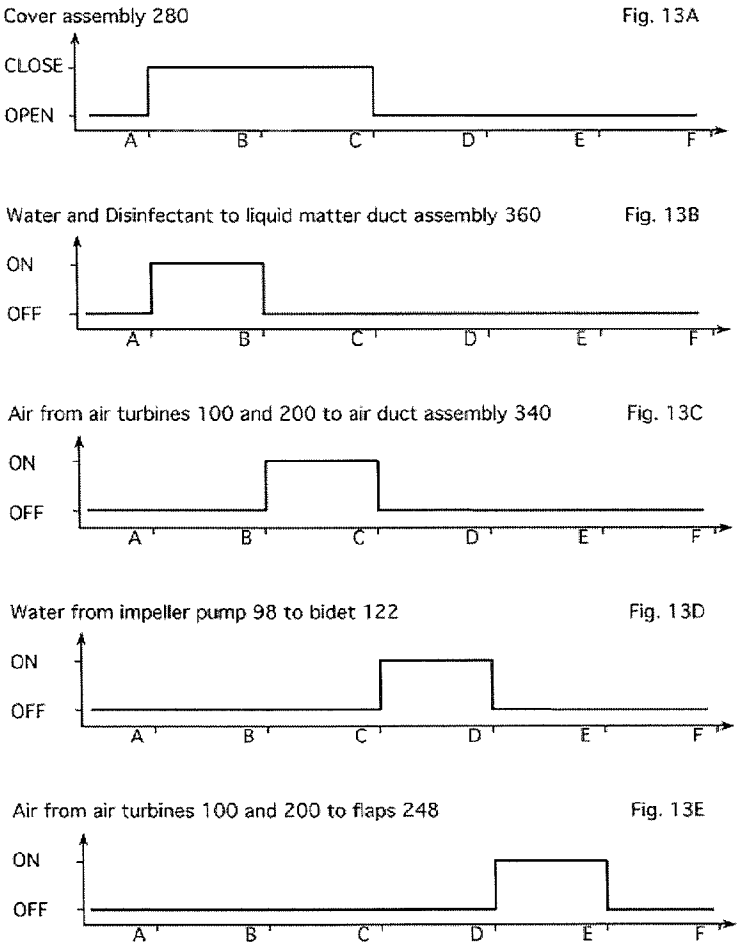
FIGS. 13A, 13B, 13C, 13D, and 13E are preferred timing charts of the cover assembly of FIGS. 1 and 10.

FIGS. 13A, 13B, 13C, 13D and 13E represent timing charts showing preferred dispositions and states of the components of instant invention 10 in a period of time as follows:

1. Period of time AB: Seat disinfectant cycle:

FIG. 13A: Cover assembly 280 is in a closed position.

FIG. 13B: Liquid matter LM is delivered through cutouts 364 of liquid matter duct assembly 360 and onto toilet seat assembly 270.

FIG. 13C: Air A from turbine assemblies 100 and 200 to air duct assembly 340 is OFF.

FIG. 13D: Water flow from impeller pump 98 to bidet 122 s OFF.

FIG. 13E: Air A flow from turbine assemblies 100 and 200 to manifold flaps 248 is OFF.

2. Period of time BC: Seat drying cycle starts:

FIG. 13A: Cover assembly 280 is in a closed position.

FIG. 13B: Liquid matter duct assembly 360 is OFF.

FIG. 13C: Air A from turbine assemblies 100 and 200 to air duct assembly 340 is ON. Air A flowing from turbine assemblies 100 and 200 is directed through air ducts 234 and 236, cutouts 228 and 232, channel 289 into air duct assembly 340, exiting through cutouts 344 to displace and/or dry the liquid matter LM from toilet seat assembly 270.

FIG. 13D: Water from impeller pump 98 to bidet 122 is OFF.

FIG. 13E: Air A flowing from turbine assemblies 100 and 200 to manifold flaps 248 is OFF.

3. Period of time CD: Anal cleaning cycle:

FIG. 13A: Cover assembly 280 is in an open position.

FIG. 13B: Liquid matter duct assembly 360 is OFF.

FIG. 13C: Air A flow from turbine assemblies 100 and 200 to air duct assembly 340 is OFF.

FIG. 13D: Water flow from impeller pump 98 to bidet 122 is ON. Water flowing from impeller pump 98 is expelled through bidet 122. Liquid matter LM pressure makes telescopic section 120 protrudes from bidet base 118.

FIG. 13E: Air A flow from turbine assemblies 100 and 200 to manifold flaps 248 is OFF.

4. Period of time DE: Anal area drying cycle:

FIG. 13A: Cover assembly 280 is in an open position.

FIG. 13B: Liquid matter duct assembly 360 is OFF.

FIG. 13C: Air A from turbine assemblies 100 and 200 to air duct assembly 340 is OFF.

FIG. 13D: Water flow from impeller pump 98 to bidet 122 is OFF.

FIG. 13E: Air A flow from turbine assemblies 100 and 200 to manifold flaps 248 is ON. Air A flowing from turbine assemblies 100 and 200 forces manifold flaps 248 to open. Air A flowing out through manifold flaps 248 is directed to the user's anal area.

Figure 14:
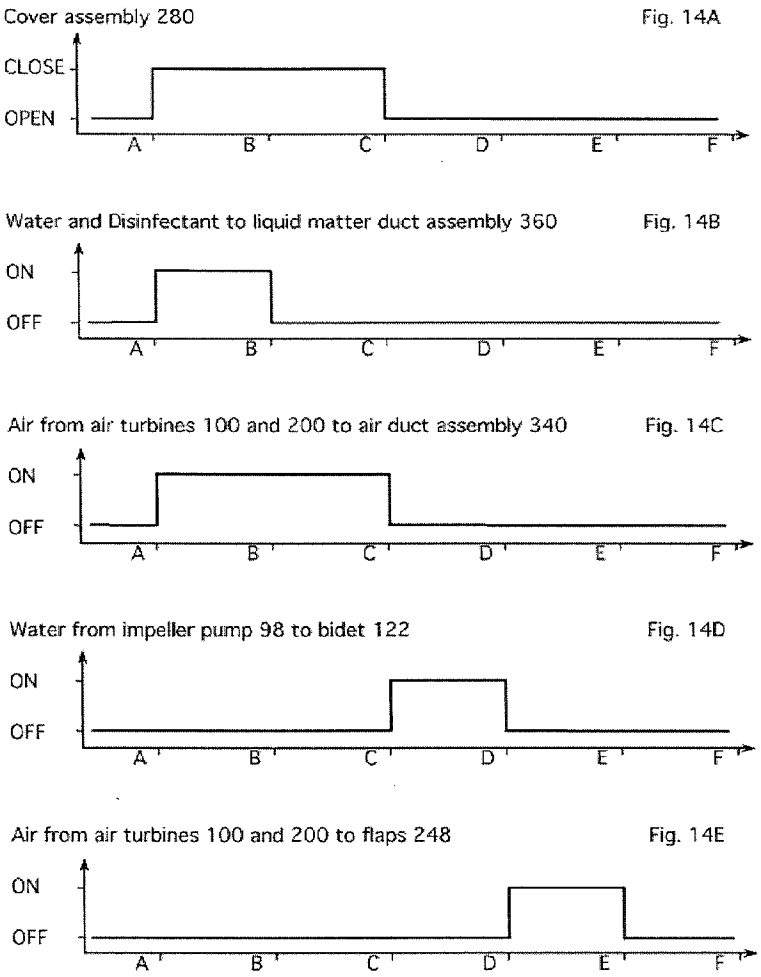
FIGS. 14A, 14B, 14C, 14D, and 14E are alternate timing charts of the cover assembly of FIGS. 1 and 10.
Figure 15:
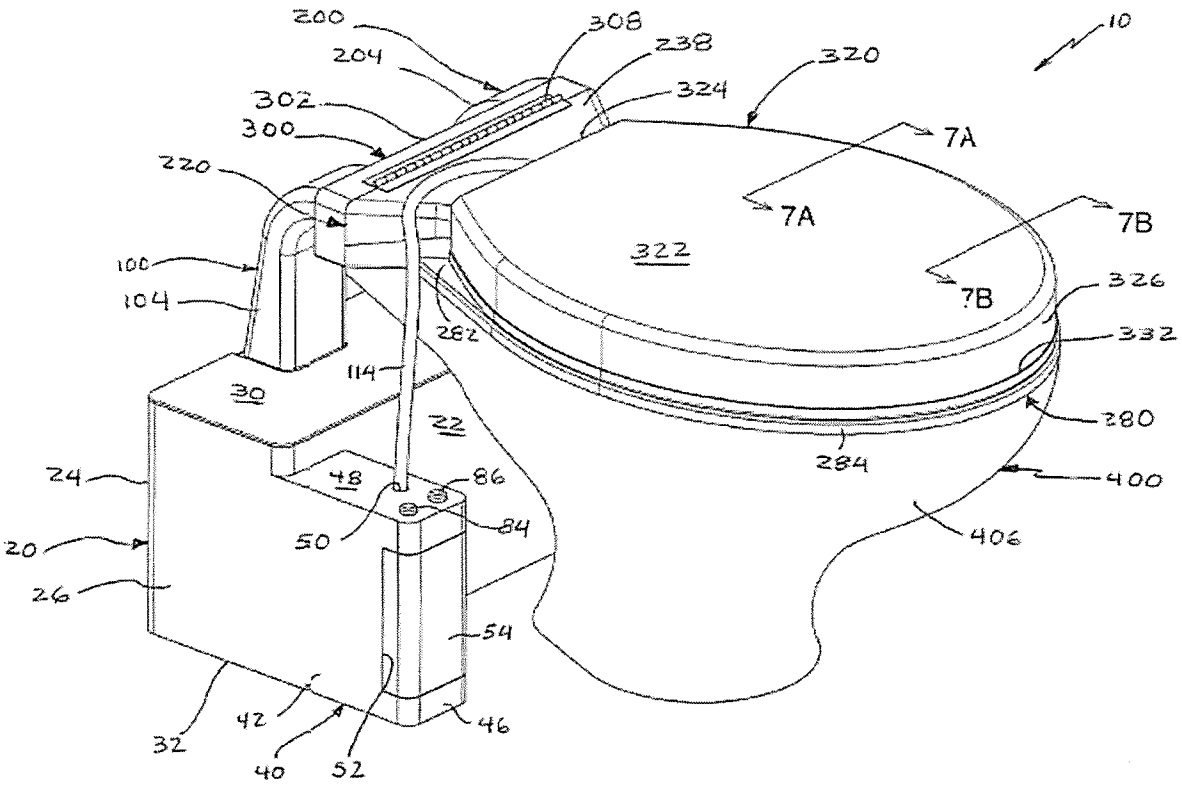
FIGS. 15-23, and their respective subparts, are various views of a cover assembly in various positions as it is installed and operating in conjunction with a toilet having a toilet seat, in accordance with another embodiment of the present invention.

FIGS. 14A, 14B, 14C, 14D and 14E represent timing charts showing alternate dispositions and states of the components of instant invention 10 in a period of time as follows:

1. Period of time AB: Seat disinfectant cycle:

FIG. 14A: Cover assembly 280 is in a closed position.

FIG. 14B: Liquid matter LM is delivered through cutouts 364 of liquid matter duct assembly 360 and onto toilet seat assembly 270.

FIG. 14C: Air A from turbine assemblies 100 and 200 to air duct assembly 340 is ON. Air A flowing from turbine assemblies 100 and 200 is directed through air ducts 234 and 236, cutouts 228 and 232, channel 289 into air duct assembly 340, exiting through cutouts 344 to displace and/or dry the liquid matter LM from toilet seat assembly 270.

FIG. 14D: Water flow from impeller pump 98 to bidet 122 is OFF.

FIG. 14E: Air A flow from turbine assemblies 100 and 200 to manifold flaps 248 is OFF.

2. Period of time BC: Seat drying cycle starts:

FIG. 14A: Cover assembly 280 is in a closed position.

FIG. 14B: Liquid matter duct assembly 360 is OFF.

FIG. 14C: Air A from turbine assemblies 100 and 200 to air duct assembly 340 is ON. Air A flowing from turbine assemblies 100 and 200 is directed through air ducts 234 and 236, cutouts 228 and 232, channel 289 into air duct assembly 340, exiting through cutouts 344 to displace and/or dry the liquid matter LM from toilet seat assembly 270.

FIG. 14D: Water from impeller pump 98 to bidet 122 is OFF.

FIG. 14E: Air A flowing from turbine assemblies 100 and 200 to manifold flaps 248 is OFF.

3. Period of time CD: Anal cleaning cycle: FIG. 14A: Cover assembly 280 is in an open position.

FIG. 14B: Liquid matter duct assembly 360 is OFF.

FIG. 14C: Air A flow from turbine assemblies 100 and 200 to air duct assembly 340 is OFF.

FIG. 14D: Water flow from impeller pump 98 to bidet 122 is ON. Water flowing from impeller pump 98 is expelled through bidet 122. Liquid matter LM pressure makes telescopic section 120 protrudes from bidet base 118.

FIG. 14E: Air A flow from turbine assemblies 100 and 200 to manifold flaps 248 is OFF.

4. Period of time DE: Anal area drying cycle:

FIG. 14A: Cover assembly 280 is in an open position.

FIG. 14B: Liquid matter duct assembly 360 is OFF.

FIG. 14C: Air A from turbine assemblies 100 and 200 to air duct assembly 340 is OFF.

FIG. 14D: Water flow from impeller pump 98 to bidet 122 is OFF.

FIG. 14E: Air A flow from turbine assemblies 100 and 200 to manifold flaps 248 is ON. Air A flowing from turbine assemblies 100 and 200 forces manifold flaps 248 to open. Air A flowing out through manifold flaps 248 is directed to the user's anal area.

Referring now to FIGS. 15-18, another embodiment of an automatic toilet seat cleaning assembly is illustrated. The automatic toilet seat cleaning and drying system, generally referred to with numeral 10, can be seen including a housing assembly 20, an electrical system 80, turbine assemblies 100 and 200, liquid matter system 110, a manifold assembly 220, a toilet seat assembly 270, a base assembly 280, manifold mounting frame assembly 300, and cover assembly 320.

The assembly 10 is mounted to a toilet 400. The toilet 400 is a fixture that usually includes a toilet bowl 406 and a rim 402 that is used for defecation and urination. Although not illustrated, it is noted that the toilet 400 may also have a tank, a flushing actuator, such as a hand or foot lever, or a button.

The housing assembly 20 may include at least one turbine assembly, and in a preferred embodiment, turbine assemblies 100 and 200 that are cooperatively positioned behind the toilet 400. The housing assembly 20 includes a front wall 22, a rear wall 24, lateral walls 26 and 28, a top wall 30, and a base 32. The housing assembly 20 also includes a tower assembly 40. Tower assembly 40 comprises lateral walls 42 and 44, front wall 46, top wall 48, hole 50, cutout 52, and front cover panel 54.

Figure 16:
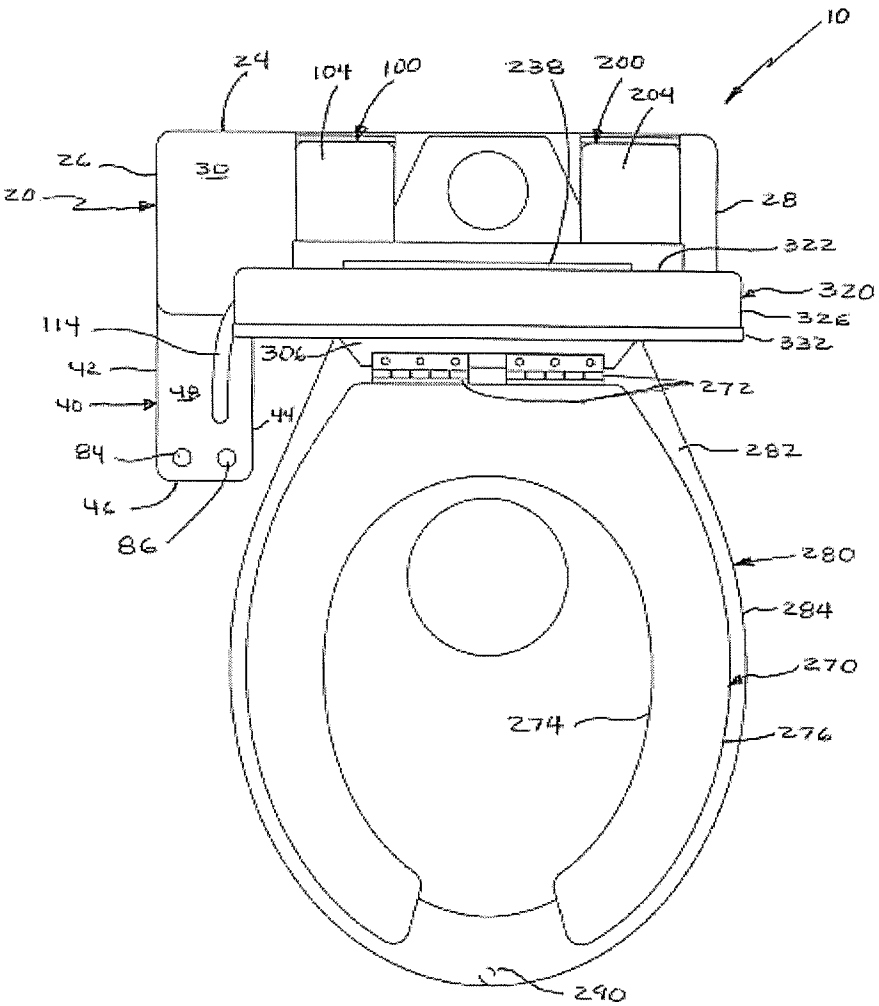

Turbine assemblies 100 and 200 extend from housing assembly 20 and secure to the manifold mounting frame assembly 300. The manifold assembly 220 is hingedly mounted to the manifold mounting frame assembly 300 with a hinge 308. Extending from the manifold mounting frame assembly 300 is a base assembly 280 that rests upon toilet 400, specifically the rim 402 seen in FIG. 17. In the closed position, as illustrated in FIG. 1, the cover assembly 320 covers toilet seat assembly 270, as shown in FIG. 16, and forms a seal against base assembly 280 with gasket 332.

Figure 17:
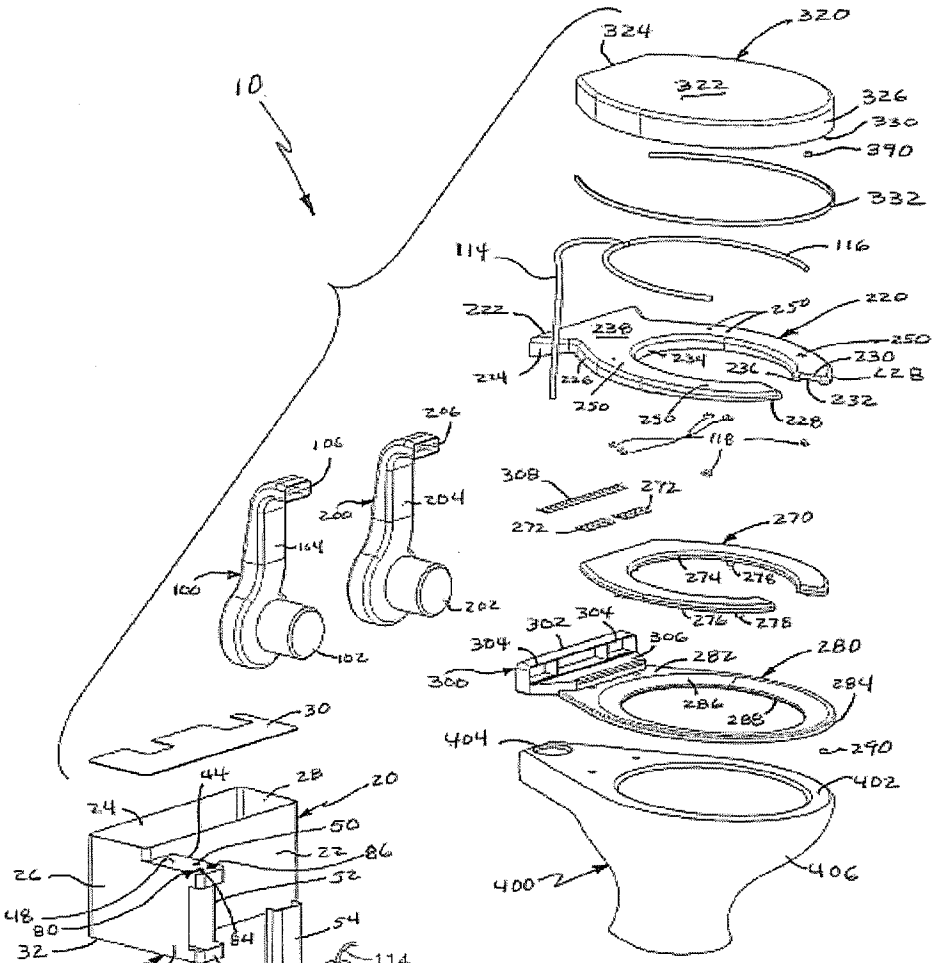
Figure 18:
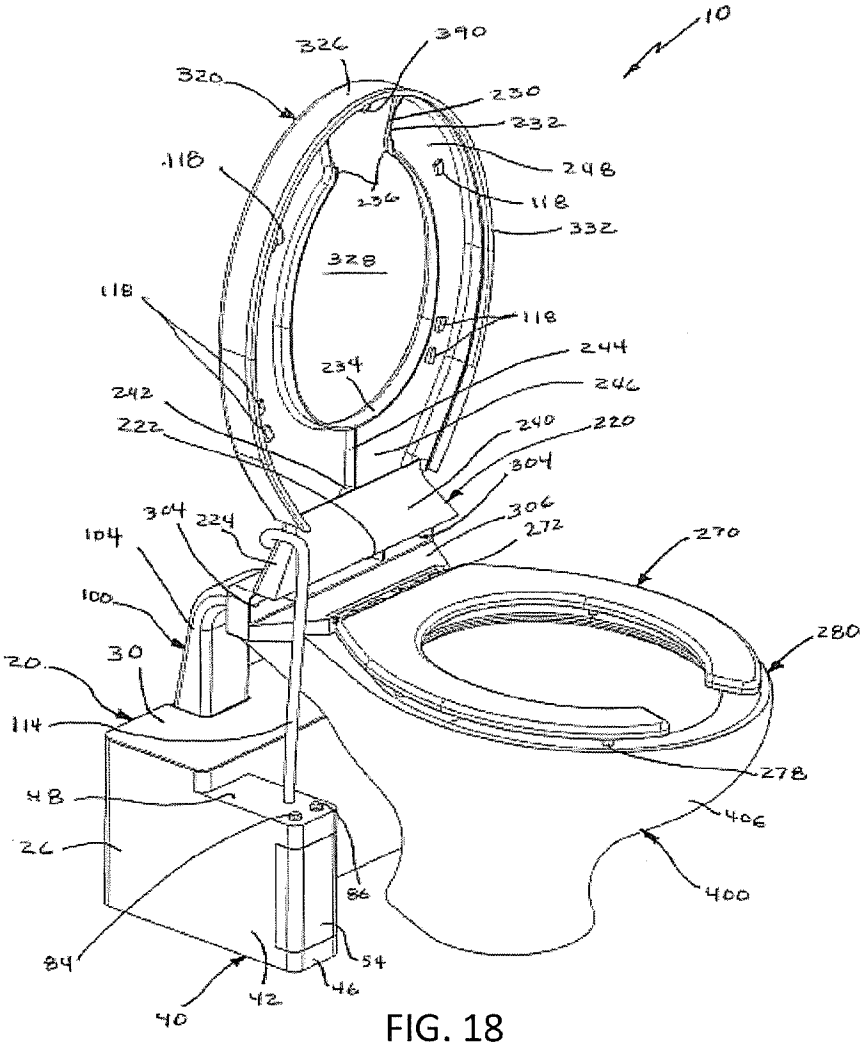
Figure 23:
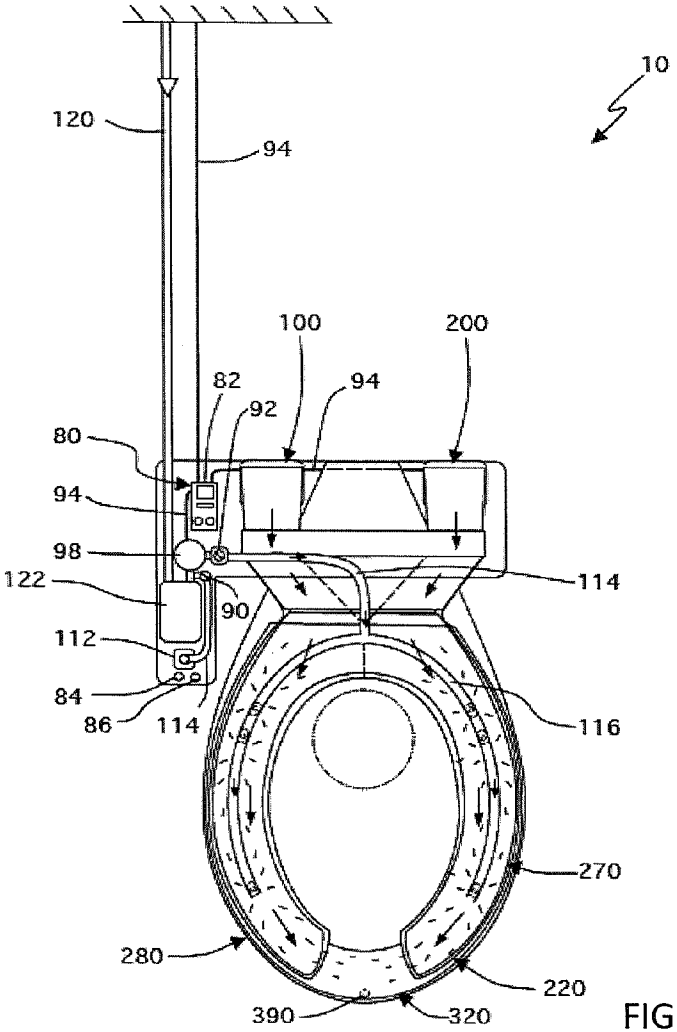

As seen in FIGS. 17 and 18, the front wall 46 of tower assembly 40 has front cover panel 54 removably mounted to the cutout 52. The tower assembly 40 and housing assembly 20 house an electrical system 80. The electrical system 80 includes a control box 82 with switches 84 and 86. The electrical system 80 may also include electrical wiring 94, as seen in FIG. 23. Also housed in the tower assembly 40 is an impeller pump 98, and disinfectant container 112 of the liquid matter system 110. The Regulator valve 90 regulates amounts of disinfectant utilized that is contained in disinfectant container 112. Extending from the disinfectant container 112, and passing through a hole 50, is a connecting line 114 that extends to the nozzle lines 116.

The turbine assembly 100 is housed within housing assembly 20 and includes a housing 102, a duct 104 and an outlet 106. The turbine assembly 100 may comprise a heating element, not shown, to produce warm/hot air. The turbine assembly 100 produces air pressure to enable washing, disinfecting, and drying of the toilet seat assembly 270 before use. A respective inlet mount 304 of the frame 302 is of a cooperative shape and dimension to snugly receive the outlet 106 at the distal end of the duct 104. Similarly, the turbine assembly 200 may include similar components and/or features as the first turbine assembly 100.

Extending from manifold mounting frame assembly 300 is a base 306. Extending from the manifold mounting frame assembly 300, and more specifically from the base 306, is a base assembly 280 that rests upon the rim 402. The base assembly 280 comprises a top wall 282, a side edge 284, an inclined wall 286, an interior edge 288, and an electromagnet 290. It is noted that inclined wall 286 inclines inwardly towards interior edge 288 so that any liquid matter, and specifically from the liquid matter system 110, will by gravity drain into toilet bowl 406. Such liquid matter may be, but is not limited too, water, water combined with other matter such as a chemical, a chemical solution, and/or a chemical solution comprising a disinfectant contained in disinfectant container 112.

Positioned onto the base assembly 280 is a toilet seat assembly 270. The toilet seat assembly 270 includes mounting brackets 272, an inner edge 274, an outer edge 276, and bumpers 278. It is noted that the toilet seat assembly 270 is mounted to base 306 with mounting brackets 272 as seen in FIG. 18.

Figure 19A:
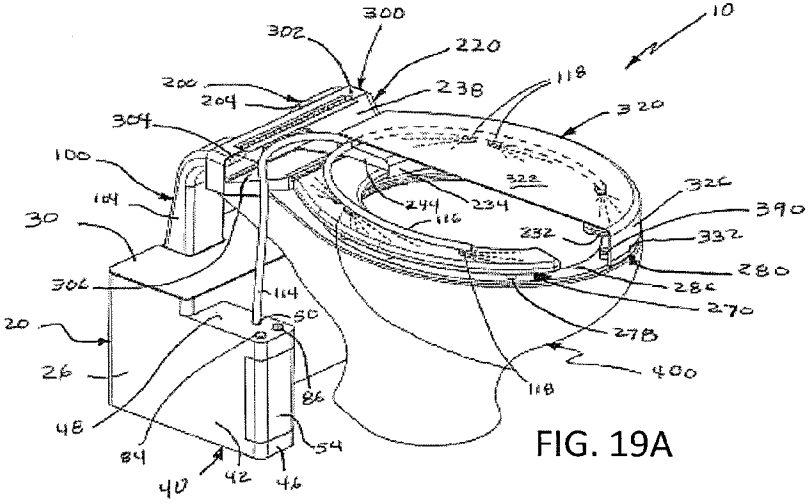
Figure 19B:
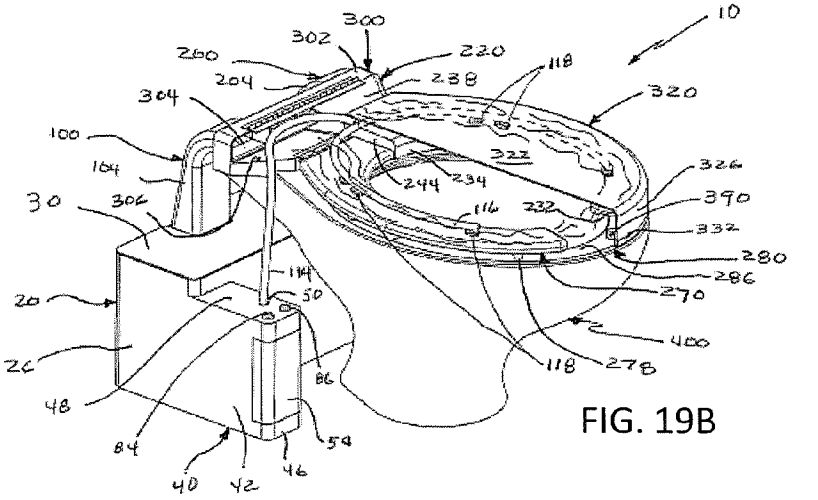

Positioned onto the toilet seat assembly 270 is a manifold assembly 220. The manifold assembly 220 comprises a manifold inlet 222, and extending from the manifold inlet 222 are a manifold top face 238, lateral walls 224, and a manifold base plate 240. Extending from the lateral walls 224 are exterior rear side edges 226 that taper to exterior forward side edges 228 and terminate to a forward wall 230 having a respective cutout 232. The manifold assembly 220 also comprises interior rear side edge 234 that also tapers to interior forward side edges 236 and also terminate at forward wall 230 having respective cutout 232. The manifold assembly 220 further comprises mounting holes 250 to receive nozzles 118. It is noted that manifold assembly 220 may be hingedly mounted to the frame 302 with a hinge 308 as seen in FIGS. 19A and 19B. In an alternate embodiment, nozzles 118 may be mounted onto manifold mounting frame assembly 300, and specifically inlet mounts 304. Additionally, the nozzles 118 may be mounted internally at a predetermined distance from the manifold inlet 222 of the manifold assembly 220.

Mounted onto the manifold assembly 220 is the cover assembly 320. The cover assembly 320 includes a top wall 322, an end 324, a sidewall 326, a bottom face 328, an edge 330, a gasket 332, and an electromagnet 390. It is noted that gasket 332 mounts onto edge 330.

As seen in FIG. 19A, the cover assembly 320 is in the closed position and is partially cross-sectioned to show the activated water system. In operation, the assembly 10 is activated with a switch 84, whereby liquid matter system 110 having liquid matter is delivered through connecting line 114, nozzle lines 116, and nozzles 118 for a predetermined period of time onto the toilet seat assembly 270. From the toilet seat assembly 270, the liquid matter drains into the toilet bowl 406. Any liquid matter landing on inclined wall 286 will by gravity also drain into the toilet bowl 406. It is noted that in the illustrated position, the cover assembly 320 covers the toilet seat assembly 270 and forms a seal against the base assembly 280 with a gasket 332. In a preferred embodiment, the cover assembly 320, a connecting line 114, nozzle lines 116, a manifold assembly 220, and nozzles 118 are made of a transparent material for a user to be able to view the assembly 10 in operation. The assembly 10 may further comprise a proximity sensor to cause cover assembly 320 to close and activate water system.

As seen in FIG. 19B, the cover assembly 320 is in the closed position and is depicted in a partially cross-sectioned view to show the activated turbine assemblies. In operation, a displacing and drying cycle starts. Air flowing from the turbine assemblies 100 and 200, causing air pressure, is directed through manifold assembly 220 that is positioned onto the toilet seat assembly 270. The tapering from exterior rear side edges 226 to exterior forward side edges 228, and from interior rear side edge 234 to interior forward side edges 236, causes an increase in air pressure to displace and/or dry the liquid matter from toilet seat assembly 270. In a preferred embodiment, the air primarily flows out from the cutouts 232. It is noted that in the illustrated position, the cover assembly 320 covers toilet seat assembly 270 and forms a seal against base assembly 280 with a gasket 332. The assembly 10 is then cleaned, sanitized, and ready for use by a user. The proximity sensor, when activated, may also cause cover assembly 320 to open once this cycle is completed.

Figure 20:
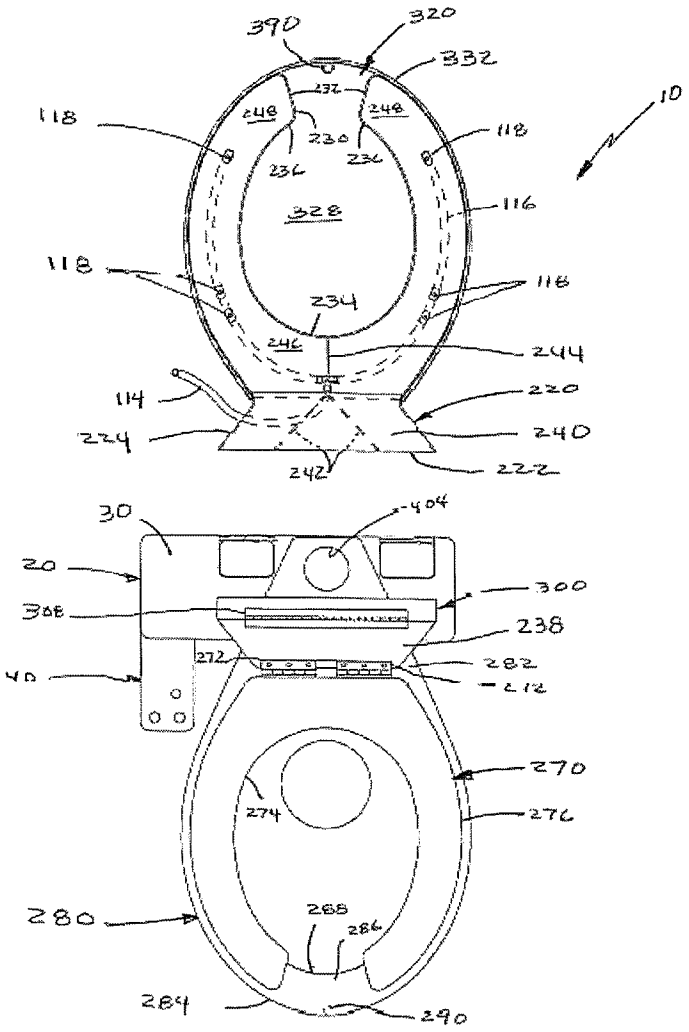

As seen in FIG. 20, the base assembly 280 includes an electromagnet 290, and the cover assembly 320 includes an electro-magnet 390. During the activated water system and activated turbine assemblies cycles defined above, the electro-magnet 290 is activated to attract the electro-magnet 390 to keep cover assembly 320 sealed against the base assembly 280 with the gasket 332.

Figure 21A:
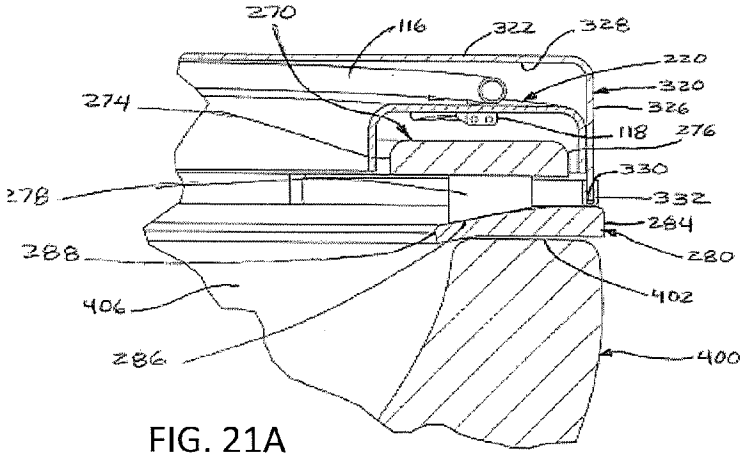
Figure 21B:
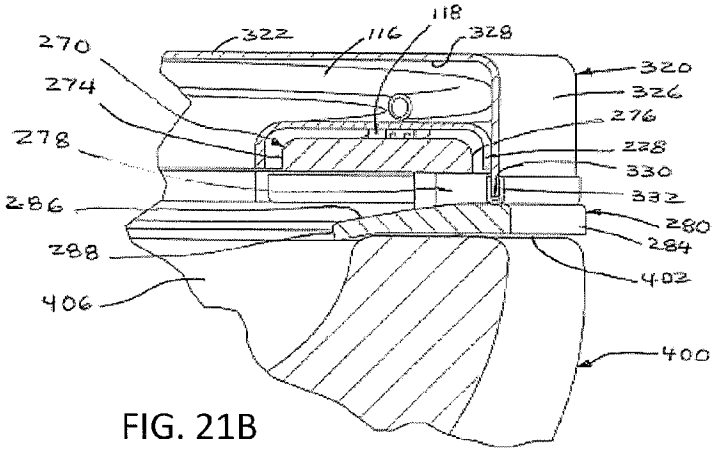

As seen in FIGS. 21A and 21B, the base assembly 280 rests upon rim 402. The inclined wall 286 inclines inwardly towards interior edge 288 so that any liquid matter, and specifically from liquid matter system 110, will, by gravity, drain into the toilet bowl 406. Positioned onto the base assembly 280 is a toilet seat assembly 270 having bumpers 278. In a preferred embodiment, the bumpers 278 may be shaped to complement an angle of inclined wall 286. Positioned onto toilet seat assembly 270 is manifold assembly 220. Mounted onto the manifold assembly 220 is the cover assembly 320. The gasket 332 mounts onto edge 330 to form a seal when cover assembly 320 is biased against base assembly 280.

Figure 22A:
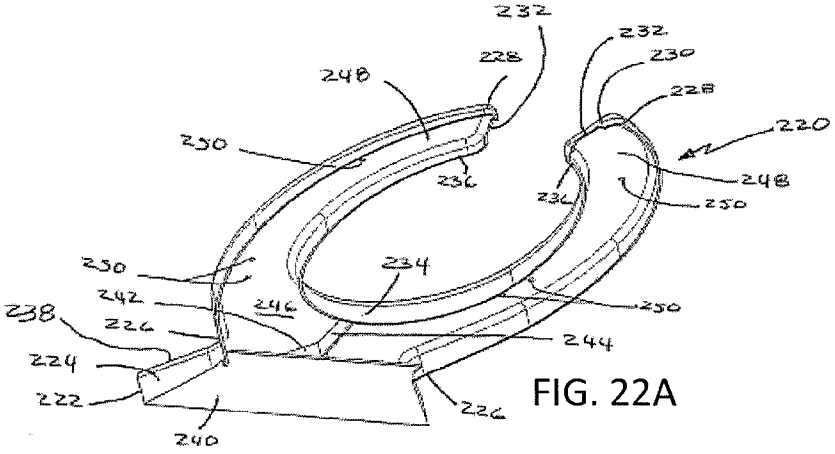
Figure 22B:
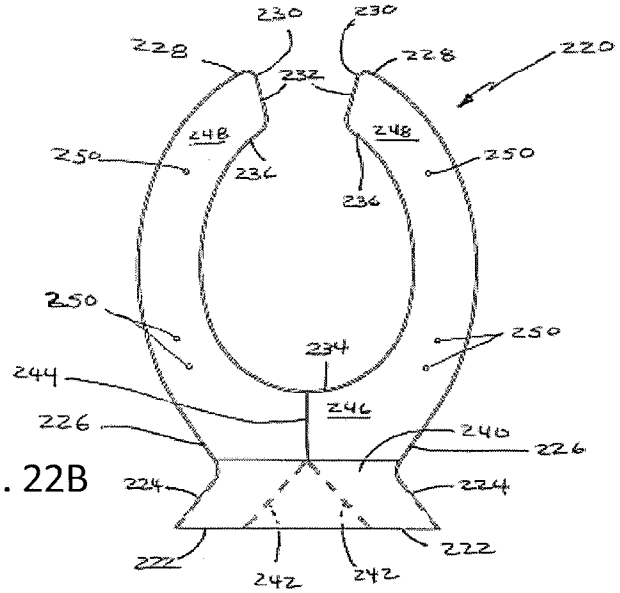

As best seen in FIGS. 22A and 22B, the manifold assembly 220 includes a manifold inlet 222, and extending from manifold inlet 222 are manifold a top face 238, lateral walls 224, and a manifold base plate 240. Extending from the lateral walls 224 are exterior rear side edges 226 that taper to exterior forward side edges 228 and terminate at forward wall 230 having respective cutout 232. The manifold assembly 220 includes an interior rear side edge 234 that also tapers to interior forward side edges 236 and also terminates at a forward wall 230 having a respective cutout 232. The manifold assembly 220 further comprises mounting holes 250 to receive nozzles 118. The manifold assembly 220 further comprises interior duct walls 242 and interior center wall 244 that serve to direct air flowing from turbine assemblies 100 and 200. The manifold assembly 220 further comprises manifold bottom face rear section 246 and manifold bottom face forward section 248.

FIG. 23 is a schematic diagram of the connections for the assembly 10. Water enters from a water source through plumbing line 120 and flows to a water reservoir 122. In an alternate embodiment, water entering from the water source through plumbing line 120 may also bypass water reservoir 122. In a preferred embodiment, a plumbing line 120 from the water source transports water to the assembly 10. From the water reservoir 122, water flows to an impeller pump 98. A pressure regulator 92 regulates water pressure from water reservoir 122 through connecting line 114, nozzle lines 116, and nozzles 118.

Air flowing from turbine assemblies 100 and 200, causing air pressure, is directed through manifold assembly 220 that is positioned onto toilet seat assembly 270. The tapering from exterior rear side edges 226 to exterior forward side edges 228, and from interior rear side edge 234 to interior forward side edges 236, causes an increase in air pressure to displace and/or dry the liquid matter from toilet seat assembly 270.

From a power source, not seen, electrical wiring 94 supplies electrical power to the control box 82, switches 84 and 86, and turbine assemblies 100 and 200. The assembly 10 is deactivated with a switch 86.

FIGS. 24A, 24B, 24C, and 24D represent timing charts showing different dispositions and states of the components of the assembly 10 in a period of time as set forth below.

Figure 24A:
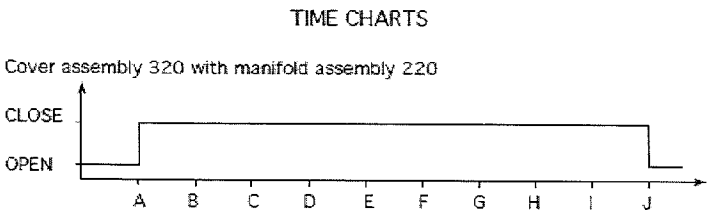
FIGS. 24A, 24B, 24C, and 24D are timing charts of the cover assembly of FIGS. 15-23, and their respective subparts.
Figure 24B:
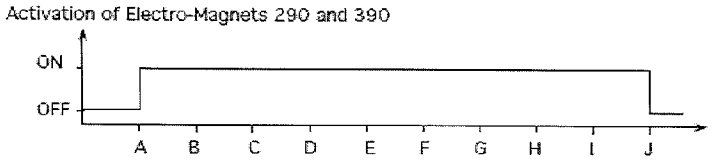
Figure 24C:
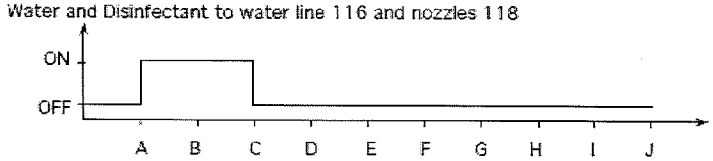
Figure 24D:
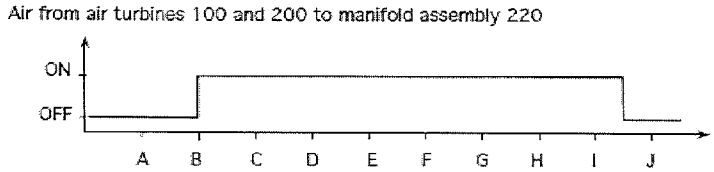

As first shown in FIG. 24A, period of time A-J: cover assembly 320 is in a closed position. In FIG. 24B, period of time A-J: electro-magnet 290 is activated to attract to electro-magnet 390 to keep cover assembly 320 sealed against base assembly 280. As seen in FIG. 24C, period of time A-C: liquid matter system 110 is activated with switch 84, whereby liquid matter is delivered through connecting line 114, nozzle lines 116, and nozzles 118 onto toilet seat assembly 270. In FIG. 24D, period of time B-between I and J: air flowing from turbine assemblies 100 and 200, causing air pressure, is directed through manifold assembly 220 to displace and/or dry the liquid matter from toilet seat assembly 270. The assembly 10 is then cleaned, sanitized, and ready for use by a user.

Figure 25:
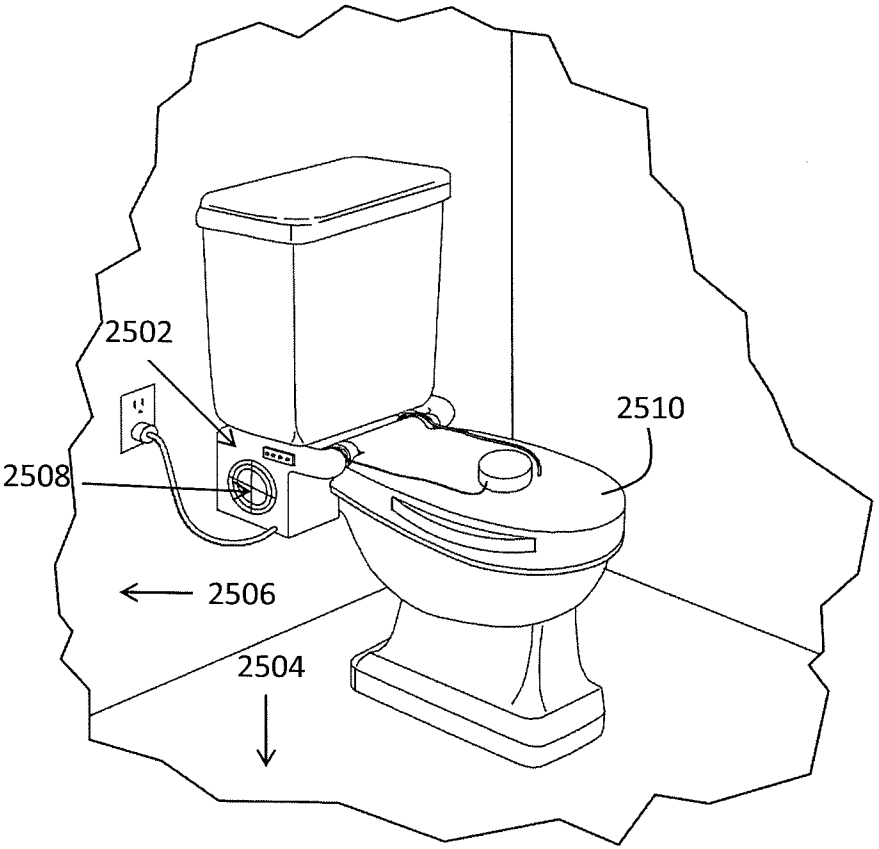
FIGS. 25-27 depict schematic views of cover assemblies with electric systems positioned in various locations in accordance with embodiments of the present invention.
Figure 27:
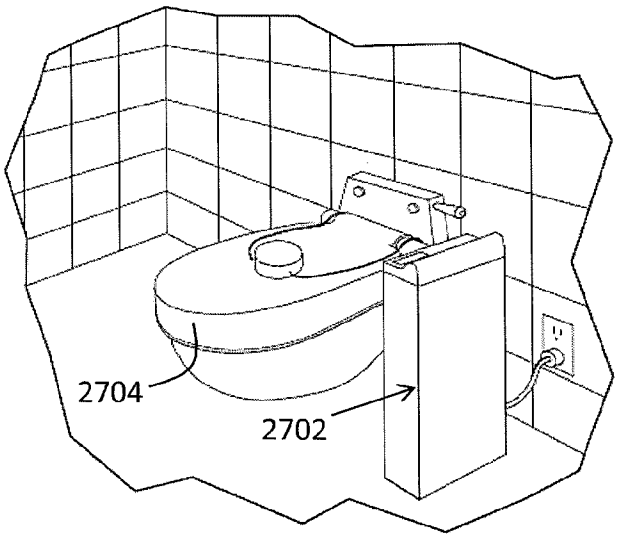
Figure 26:
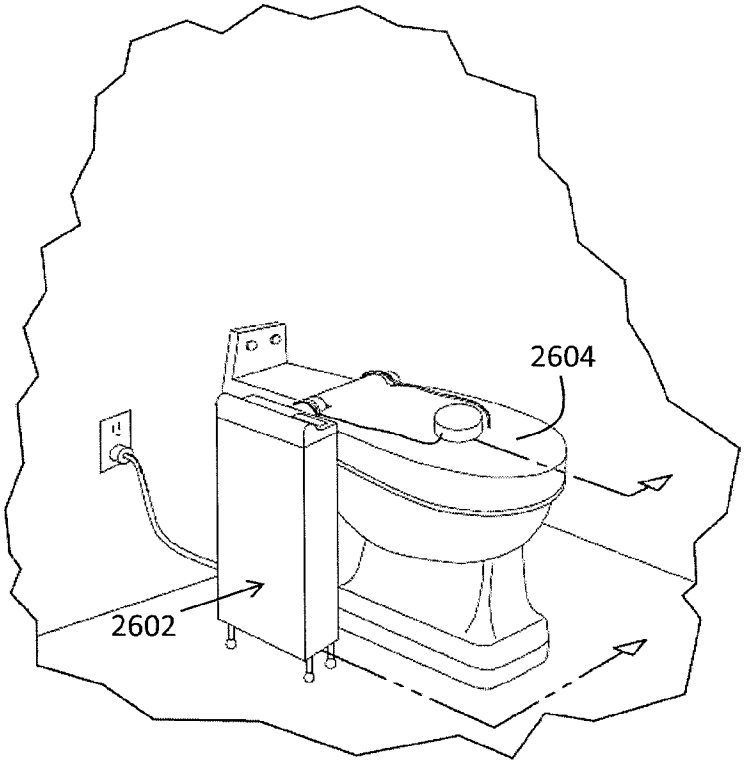

With reference now to FIGS. 25-27, schematic views of cover assemblies 2500, 2600, 2700 can be seen. The assemblies 2500, 2600, 2700 each include electrical systems 2502, 2602, 2702 positioned in various locations in accordance with embodiments of the present invention. More specifically and with reference to FIG. 25, in one embodiment the assembly 2500 has the electrical system 2502 principally positioned off the floor 2504 and juxtaposed to the wall 2506. The electrical system 2502 can be seen having an airflow system exposed 2508, which may be incorporated therein, such that an air flow or a vacuum may be induced in the cover 2510. FIGS. 26 and 27 depict an electrical system 2602, 2702 adjacent to the cover 2604, 2704 and placed in alternative positions.

Figure 28:
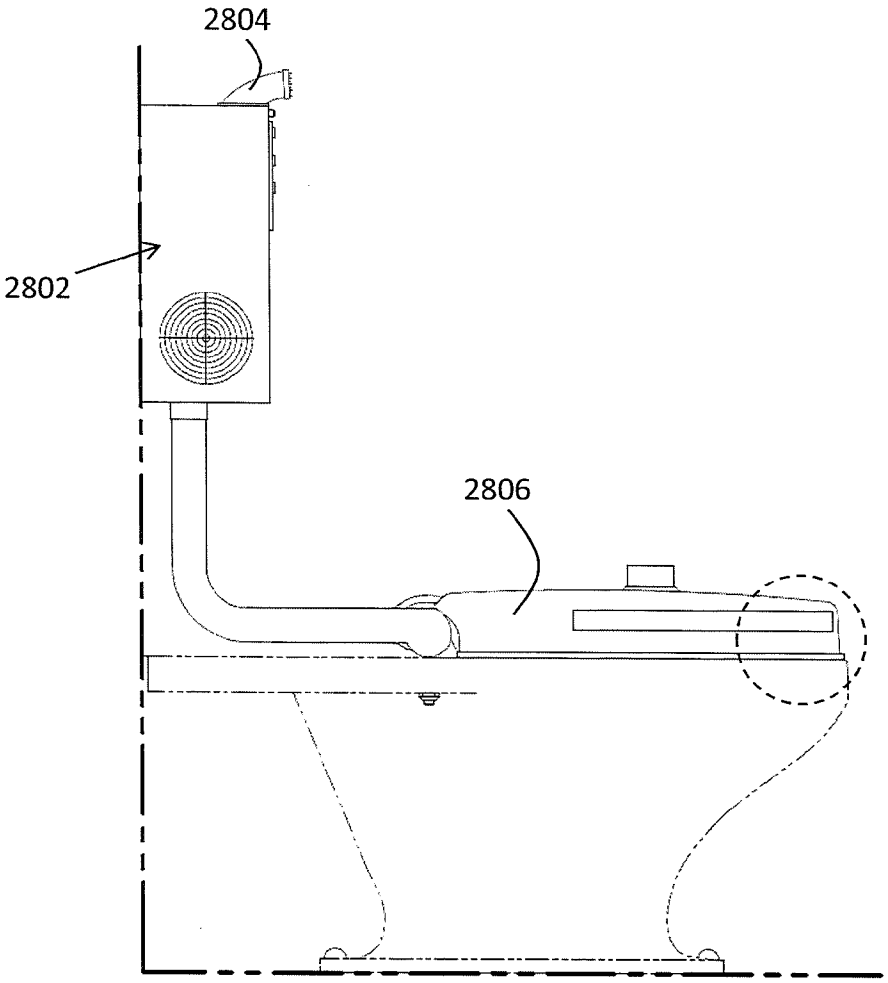
FIG. 28 depicts an elevational side view of an automatic toilet cleaning assembly in accordance with an embodiment of the present invention.

FIG. 28 also depicts an automatic toilet cleaning assembly 2800 with an electrical system 2802 positioned in an alternative embodiment in accordance with the present invention. The assembly 2800 may include an exhaust or intake portion 2804 that may be used to facilitate in the production of airflow in the cover 2806. It should be noted that the electrical systems 2502, 2602, 2702, 2802 illustrated in FIGS. 25-28 may be used in other embodiments of the toilet cleaning assemblies described herein. The electrical system 2802 may house or control various components and sub-components of the assembly 2800, including an output device operable to display advertising medium, play music, connect a blow dryer, connect electronic devices, measure/display blood pressure of a user, or measure/display the weight of a user using the assembly 2800. With regard to measuring the weight of a user, the assembly 2800 may utilize a digital or analog scale incorporated into the seat of the device to measure the weight of the user and then communicate the weight to the user through one or more displays.

Figure 29:
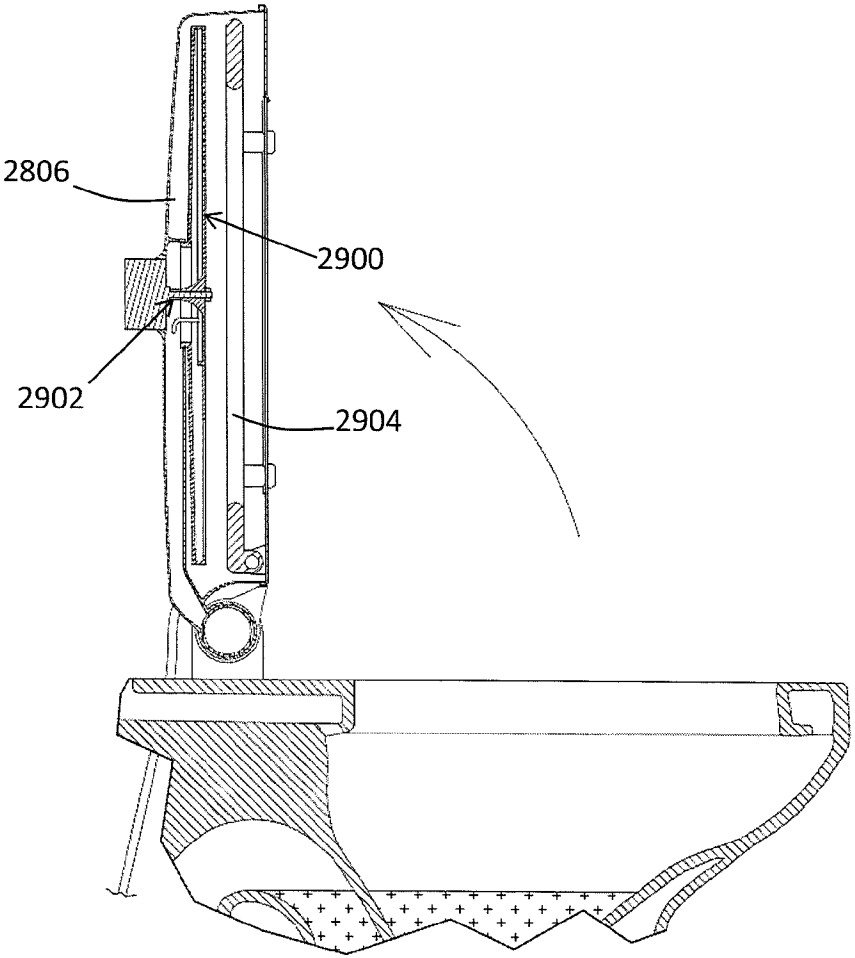
FIG. 29 is a fragmentary elevational side view of the assembly of FIG. 28 with a cover in an open position.
Figure 30:
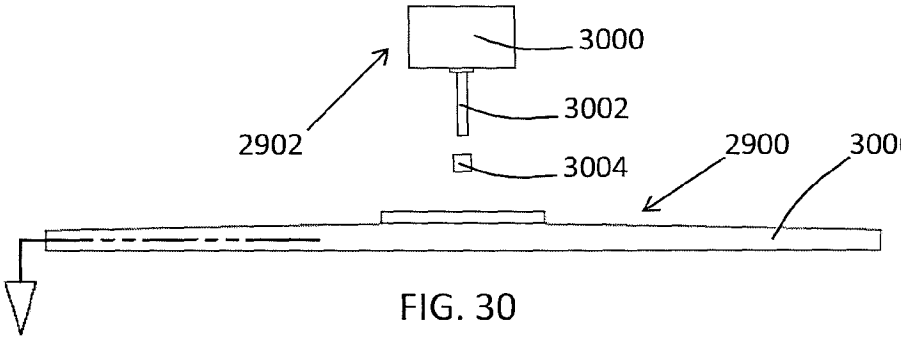
FIGS. 30-32 depict exploded and sectional views of a motor and arm assembly used in the automatic toilet cleaning assembly of FIG. 28.
Figure 31:
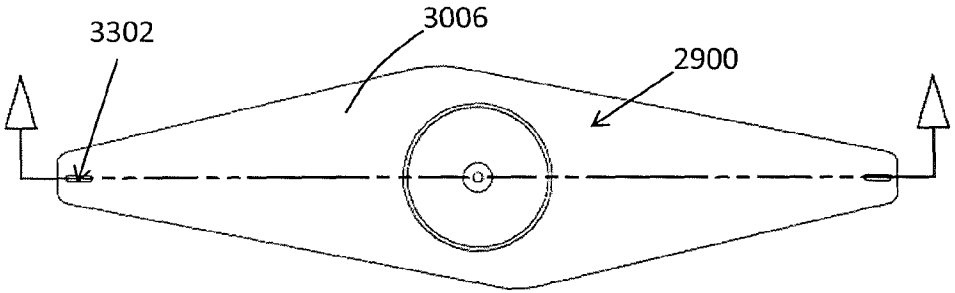
Figure 32:
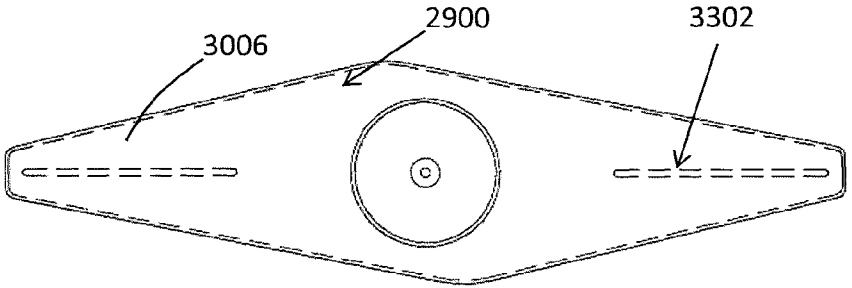

With reference now to FIG. 29, the cover 2806 advantageously includes an arm assembly 2900 that is driven by a regulated motor assembly 2902. The cover 2806 is shown in the open position. The arm and motor assemblies 2900, 2902 are shown in various views of FIGS. 30-32. FIG. 30 depicts an exemplary motor 3000 with a shaft 3002 that, in one embodiment, has a spline adapted to mate with a portion of the arm assembly 2900 and be secured with a fastener 3004. In other embodiments, the arm assembly, more specifically, the arm

3006 may be driven, i.e., rotated, through other fastening means known to those of skill in the art. As discussed herein, the arm assembly 2900 may have a liquid supply and/or gas supply fluidly, and centrally, coupled thereto, so as to allow the liquid and gas to emit or discharge over the toilet seat 2904.

Advantageously, the motor assembly 2902 may be regulated to provide the optimal, effective, and efficient cleaning cycle of the toilet seat 2904. Said another way, the toilet seat cleaning assembly 2800 permits a user to control the speed of the arm 3006, which correspondingly may control the amount fluid discharged on the toilet seat and the time of the fluid exposure. In embodiment, this motor 3000 may be regulated with varying the electric impulses or supply to the motor 3000. In other embodiments, the motor 3000 may be regulated with the use of a clutch(es) or other mechanical/electrical device that provides for the transmission of power from one component to another component. The clutch may be electronically controlled so as to regulate the rotational speed of the arm 3006.

Figure 33:
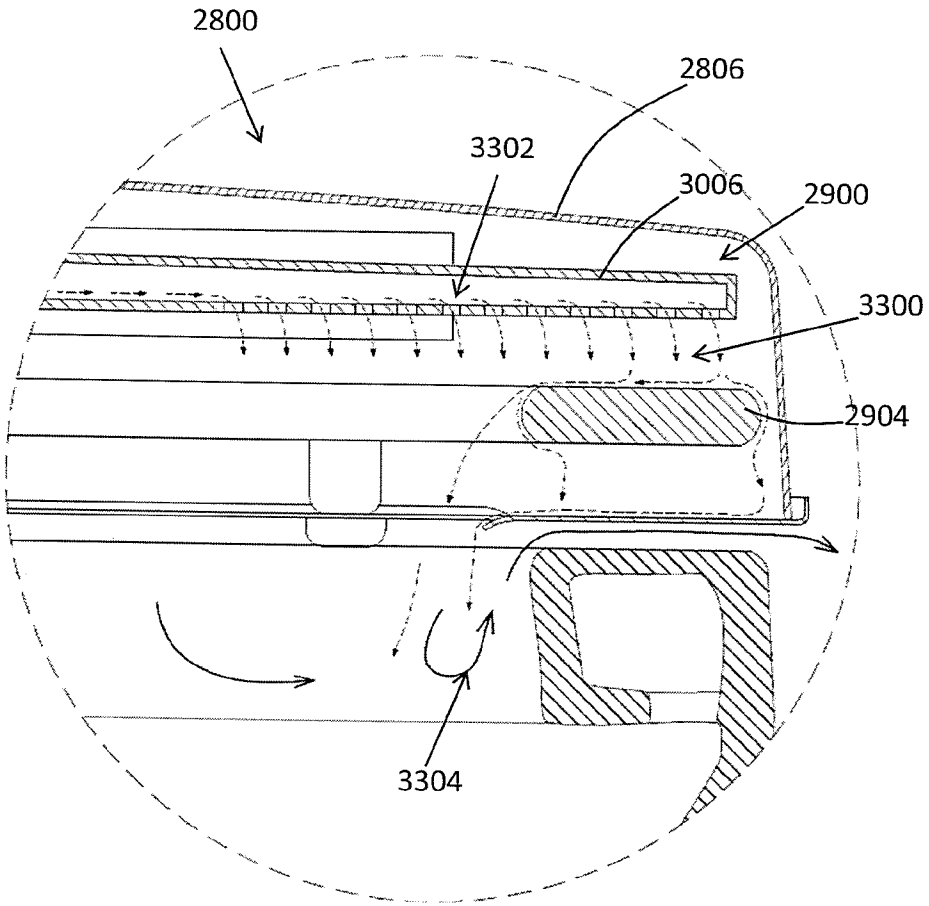
FIG. 33 is a sectional close-up view of the cover of FIG. 29 in a closed position

For example, when the liquid is discharged over the toilet seat 2904 the arm 3006 may be rotated at approximately 20 RPM so as to quickly disperse the fluid over the toilet seat 2904 (as shown in FIG. 33). After discharge of the liquid, gas may be discharged with the arm moving at a speed of approximately 5 RPM. The present invention is not limited in terms of temporal discharge of the fluid and gas, and those of skill in the art can appreciate that the fluid and gas may discharge at various times and in varying amount and in differentiated and staggered fashion, e.g., gas-discharge, liquid-discharge, and gas-discharge. Therefore, as opposed many known rotating toilet seat cleaning assemblies, the cover assembly 2800 does a limited number rotations so as ensure an effective and efficient cleaning cycle by preserving fluid and power exerted by the motor 3000 to continually cause rotation of the arm 3006. Said another, the cover assembly 2800 is more energy efficient and often quieter than those known assemblies when in operation.

FIG. 33 depicts a sectional view of the assembly shown in FIG. 28. More specifically, FIG. 33 illustrates the assembly 2800 in operation. The arm assembly 2900 can be seen discharging liquid 3300 through one or more apertures 3302 as it rotates centrally around the toilet seat 2904. The gas may also discharge through said apertures 3302 or other apertures located on the arm assembly 2900. Gas 3304 can also be seen escaping through the assembly 2800 to prevent turbulence of the cover 2806 when in operation.

Figure 34:
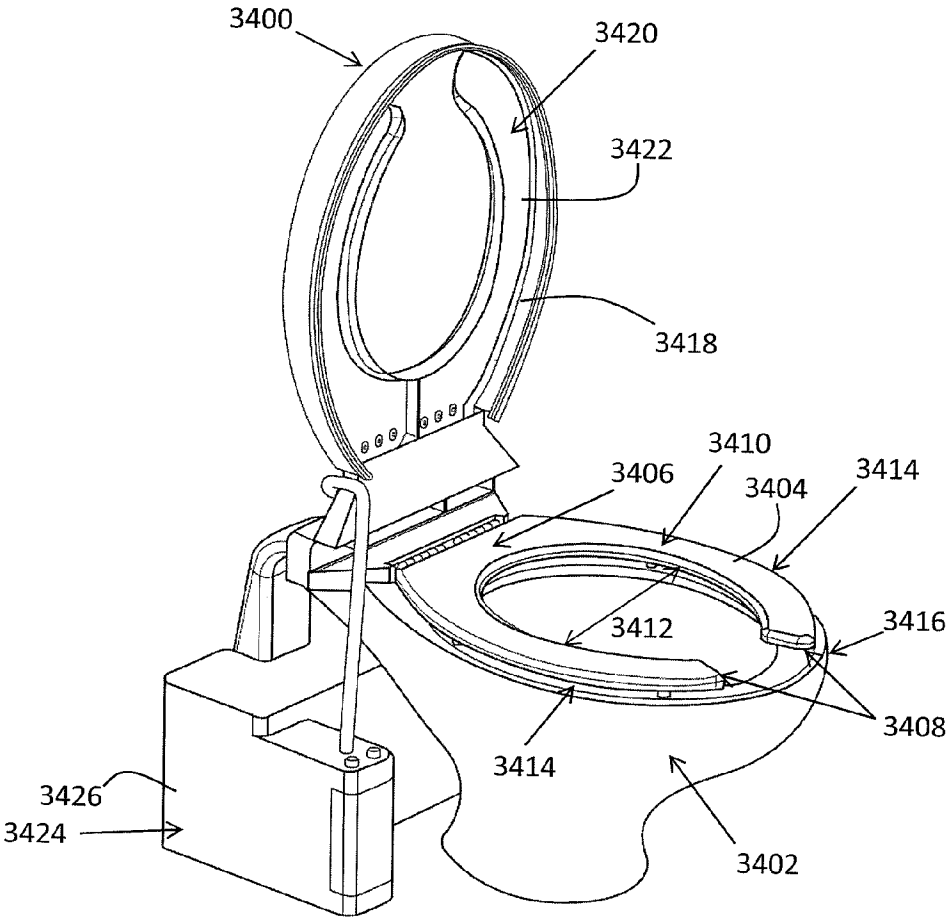
FIG. 34 is a perspective view of an automatic toilet cleaning assembly including a cover coupled to a toilet and in an open, second, position in accordance with the present invention.

With reference to FIG. 34, another embodiment of a cover assembly 3400 is shown coupled to a toilet 3402 having a toilet seat 3404. The toilet seat 3404 has a back end 3406, a front end 3408, a top surface 3410, and inner and outer circumferential surfaces 3412, 3414. The illustrated toilet seat 3404 is merely exemplary of standard toilet seat. In other embodiments, the toilet seat 3404 may be completely round, and not of a generally U-shape, such that the front end 3408 would be an end proximal (within approximately 1-2 inches) from the front rim 3416 of the toilet. The inner and outer circumferential surfaces 3412, 3414 are generally where the top surface 3410 of the seat 3404 terminates, e.g., the lateral edges of the seat 3404, but it may also include side surfaces of the toilet seat 3404.

Figure 36:
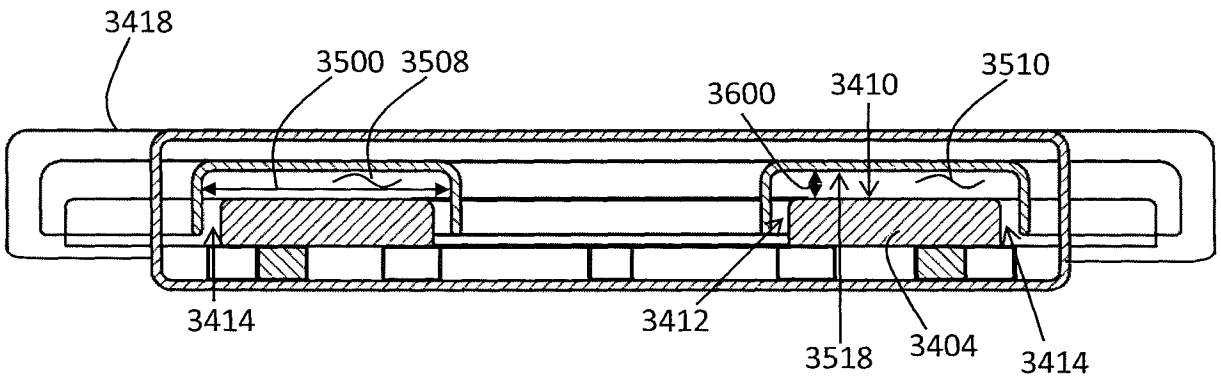
FIG. 36 is a fragmentary cross-sectional view, along a-a, of the cover of FIG. 35 with a conduit that transports liquid and gaseous matter in accordance with an embodiment of the present invention.
Figure 37:
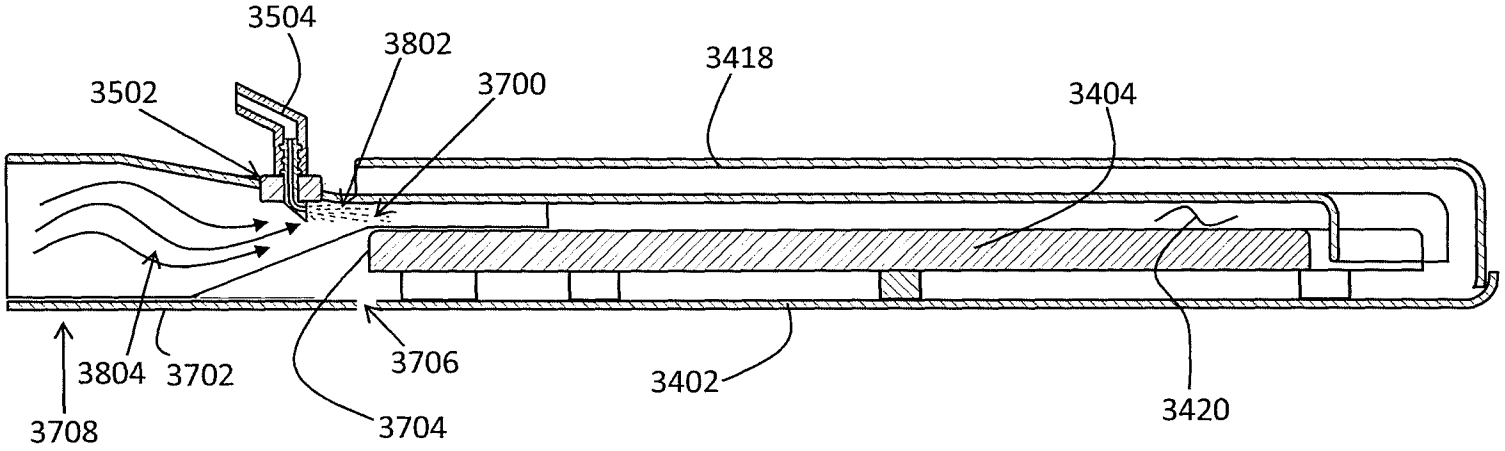
FIG. 37 is a fragmentary cross-sectional view, along b-b, of the cover of FIG. 35 with a conduit that transports liquid and gaseous matter from the back end of the toilet seat to the front end of the toilet seat in accordance with an embodiment of the present invention.
Figure 38:
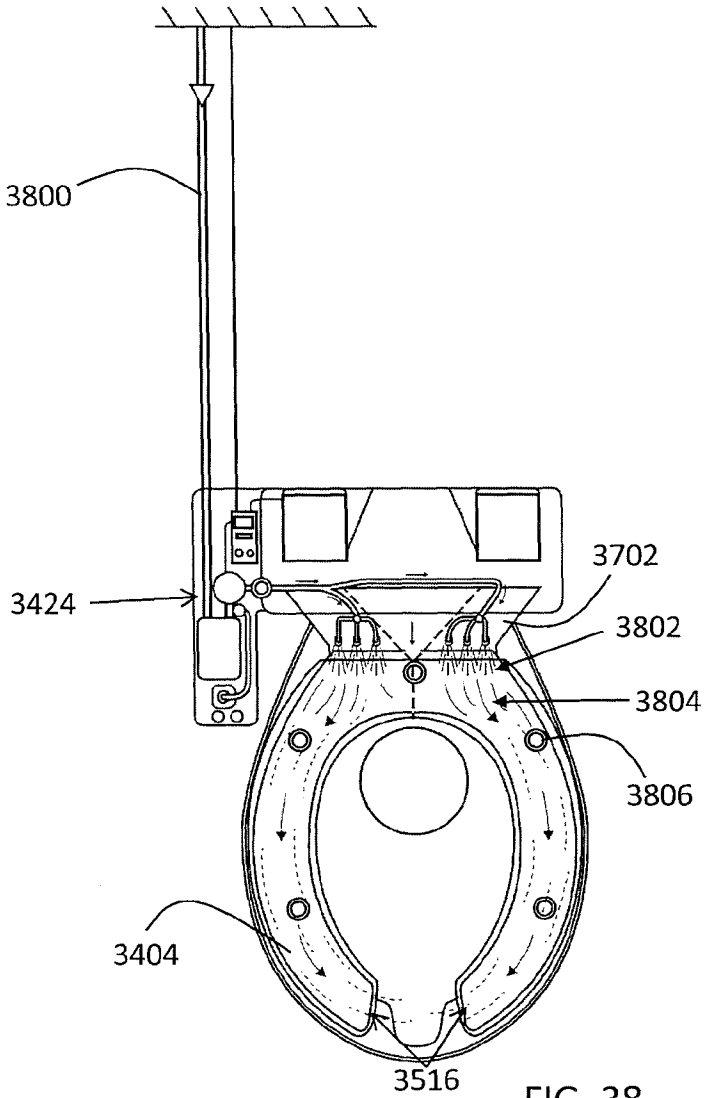
FIG. 38 is a top view of the assembly of FIG. 34 with a demonstrable flow of liquid and gaseous matter through the conduit when the assembly is in operation in accordance with an embodiment of the present invention.

As discussed above, the cover assembly 3400 includes a cover 3418 coupled directly to the toilet 3402, e.g., through a hinged-like attachment, that has an open position and a closed position along a translation path to and from, or back-and-forth with, the toilet seat 3404. FIG. 34 depicts the cover 3418 in an exemplary open position, e.g., when the cover removed from above a portion of the toilet seat, while FIGS. 36-38 depict the cover 3418 in a closed position. In one embodiment, when the cover 3418 is in the closed position, the cover 3418 surrounds the toilet seat 3404 to define a conduit 3420, or channel, spanning from the back end 3406 of the toilet seat 3404 to the front end 3408 of the toilet seat 3404. The conduit 3420 is partially defined by an inner surface 3422 of the cover 3418, as shown in FIG. 34. The conduit 3420 advantageous provides the cover 3418 the ability to facilitate in channeling any gaseous matter, e.g., air, around the toilet seat 3404 so as to transport a liquid matter, e.g., a disinfectant agent, around the top surface 3410 of the toilet seat 3404. In said manner, the assembly 3400 uniquely provides a cost-efficient, yet effective, means of cleaning the top surface 3410 of the toilet seat 3404. Said another way, the assembly 3400 is advantageous over those known seat-cleaning assemblies because there are minimal moving parts and an assembly that is relatively simple and ergonomic. The disinfectant agent may be an alcohol based agent, an oxidizing agent, or any other agent the will inhibit or kill microorganisms.

With reference to both FIGS. 36 and 37, to facilitate transporting the disinfectant agent and air around the toilet seat 3404 the conduit 3420 has a width 3500 spanning approximately from the inner circumferential surface 3412 to the outer inner circumferential surface 3414 of the toilet seat 3404. Said another way, the width 3500 extends to and from said surfaces 3412, 3414, up to a 0.0625-0.5" variance. The cover 3418 defines at least one liquid aperture 3502 fluidly coupled, through a fluid channel, e.g., 3504, to a liquid source (not shown) with a liquid matter. FIGS. 36 and 37 depict exemplary liquid apertures 3502*a-f* that facilitate in discharging liquid matter onto the toilet seat 3404. In one embodiment, there may be only one liquid aperture fluidly coupled to the liquid source. In other embodiments, a plurality of liquid apertures, as shown in FIG. 35, are fluidly coupled, through a plurality of fluid channels, e.g., 3504, to the liquid source.

The cover 3418 has a distance 3600 separating the top surface 3410 of the toilet seat 3404 and an upper surface 3518 of the cover 3418. This distance 3600 also represents a dimension of the conduit 3420. In one embodiment, the distance 3600 tapers as the conduit 3420 spans from the back end of the toilet seat 3404 to the front end of the toilet seat 3404. The tapering, or reduction, of the distance 3600, in addition to the area of the conduit 3420, acts to increase the speed of the airflow in the conduit 3420 or facilitate and/or maintain airflow speed through the conduit 3420. As the airflow advantageously increases, so does the flow of liquid over the toilet seat 3404.

With reference to FIGS. 37 and 38, the toilet seat 3404 can be seen also defining at least one gas aperture 3700 in fluid communication with the conduit 3420 and fluidly coupled, through a gas channel 3702, to a gas source (not shown) with a gaseous matter, e.g., compressed air. The plurality of the side walls of the cover 3418 can also be seen extending downwardly away from an inner surface of the cover 3418, to both the inner circumferential surface and the outer circumferential surface of the toilet seat 3404, so as to provide an escape barrier of gaseous matter flowing through the conduit 3420 (exemplified in FIG. 38). With reference briefly back to FIG. 35, the cover 3418 can be seen defining two exemplary gas apertures 3700*a* and 3700*b* that facilitate in supplying the gaseous matter over and across the top surface of the toilet seat 3404. In one embodiment, there may be only one gas aperture 3700 fluidly coupled to the gas source. In other embodiments, a plurality of gas apertures, as shown in FIG. 35, are in fluid communication, through a plurality of gas channels, to the gas source.

Figure 35:
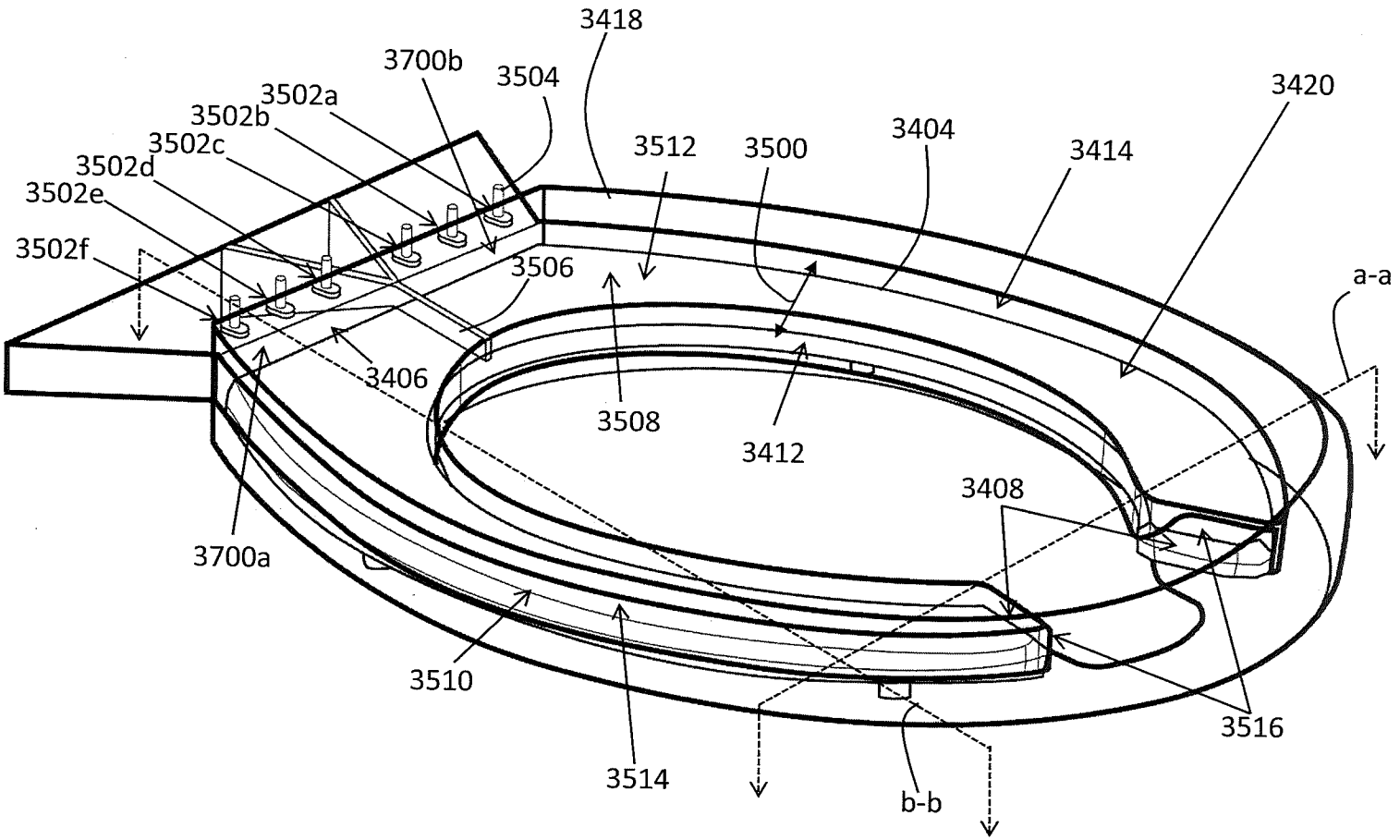
FIG. 35 is a fragmentary perspective view of the cover of FIG. 34 in a closed, first, position with a toilet seat in accordance with an embodiment of the present invention.
Figure 39:
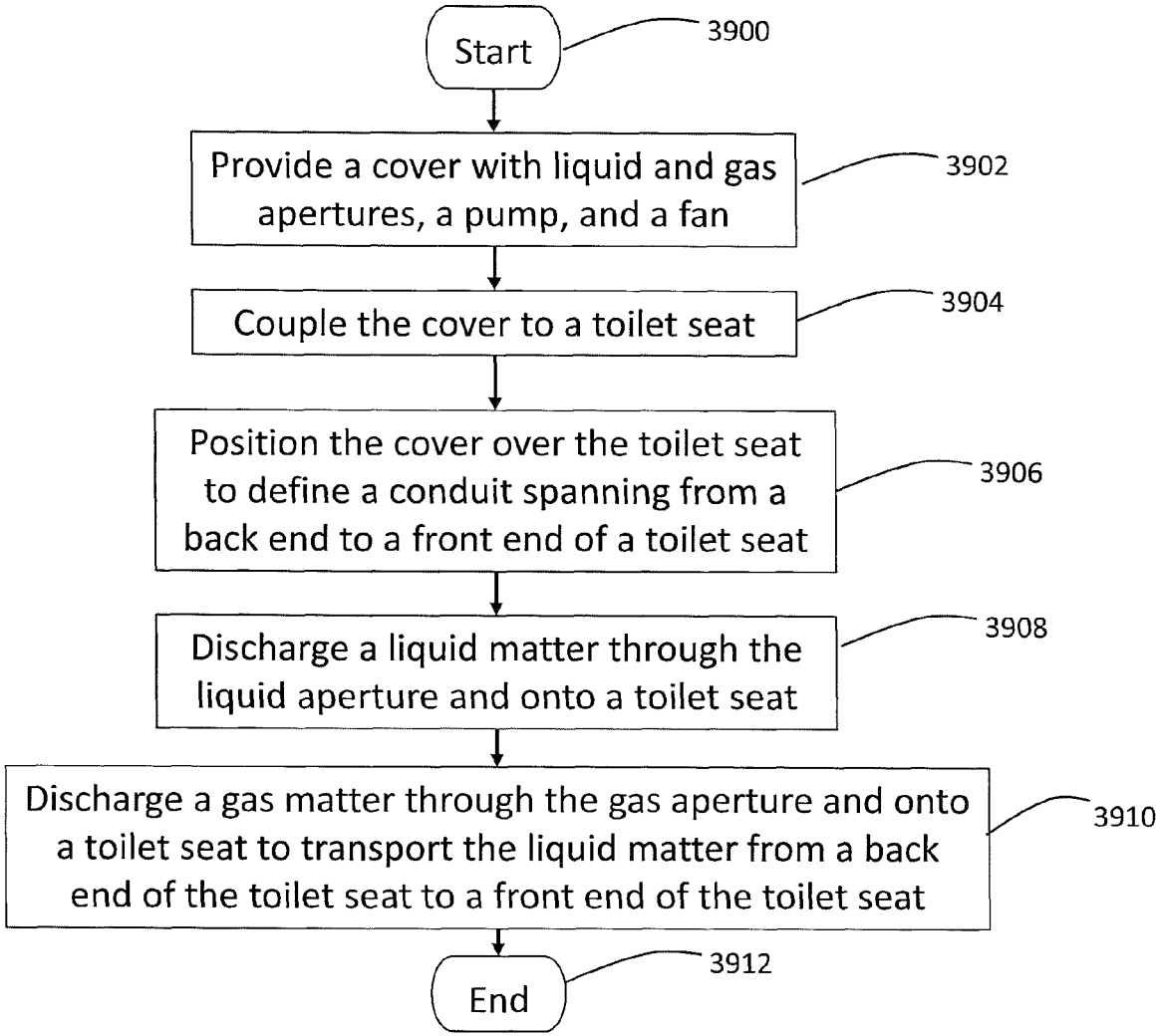
FIG. 39 depicts an exemplary process flow diagram of a method of automatically cleaning a toilet seat in accordance with the present invention.

With reference to FIGS. 35 and 39, the assembly 3400 includes an electrical system 3424 that is operably coupled to a pump-like device and a fan-like device. The pump-like device may be, for example, a pump or any other device that moves fluid by mechanical action. The pump-like device may also include a device utilized in connection with a housing structure to which the toilet is coupled to. The electrical system 3424 has been described above, but is also operable to cause the liquid matter, e.g., 3802 (shown in FIGS. 37 and 38), to discharge through the plurality of liquid apertures 3502 onto the portion of the toilet seat 3404. In one embodiment, the liquid 3802 is discharged proximal, within approximately 0-6 inches, to the back end 3406, e.g., where the toilet seat 3404 terminates into a toilet seat edge 3704 (shown in FIG. 37), of the toilet seat 3404. The liquid 3802 may also flow through one or more valves, communicatively coupled to the electrical system 3424 through wiring, which are operably opened and closed to allow/restrict the liquid matter to flow through the liquid channels 3504. An exemplary liquid channel 3800 can also be seen depicted in FIG. 38. Fluid flow may also be induced through other known methods, such as the Venturi effect.

The fan-like device may be, for example, a fan, blower, compressor, or any other device that is capable of moving a gaseous matter by mechanical action. The fan-like device is operable to induce of a flow of the gaseous matter from the gas source to the at least one gas aperture 3700 through the gas channel 3702. In certain embodiments, the fan-like device is operable to invert its rotation so as to remove gas from the conduit 3420, thereby inducing a vacuum therein. As such, in certain variations of the cover 3418, it is adapted to be fitted on the toilet seat 3404 (when in the closed position) to be in an air-tight configuration the same, or with a minimal loss of fluid flow through the conduit 3420 and the ambient environment. As such, the liquid matter may be discharged on the other end 3408 of the toilet seat 3404 and then removed at the opposite end 3406, through use of the vacuum generated in the conduit 3420. The gas source may be any environment with a gaseous substance. As such, in one embodiment the gas source is the ambient environment around the assembly 3400. In other embodiments, the gas source may be compressed air internal of the housing 3426 of the electrical system 3424. The electrical system 3424 may consist of one component or may include various subparts, components, or features without deviating from the scope of the present invention.

As demonstrated in FIGS. 37 and 38, the electrical system 3424 is operable to cause the gaseous matter 3804, e.g., air, to discharge through one or more gas apertures 3700 and operable to cause the liquid matter 3802 to discharge onto a portion of the toilet seat 3404 proximal to the back end of the toilet seat 3404 through the at least one liquid aperture 3502. To prevent or inhibit leaks in the assembly 3400, discharge should occur when the cover 3418 is in the first position with respect to the toilet seat 3404. Advantageously, the gaseous matter 3804 is discharged through the at least one gas aperture 3700 at a speed sufficient to transport the liquid matter 3802 through the conduit 3420. Said another way, the speed of the air 3804 is sufficient to move the liquid matter 3802 discharged on the back end of the toilet seat 3404 to the front end of the toilet seat so as to clean and/or disinfect the top surface of the toilet seat 3404. In one embodiment, the speed of the air is approximately 50-150 ft/s. In other embodiments, the speed may be less than 50 ft/s, but those of skill in the art can appreciate that the speed should be sufficient to transport the liquid around the top surface of the toilet seat 3404 and may be varied based on the liquid being transported and the dimensions of the conduit 3420. To prevent turbulence of the cover 3418 when the assembly is in operation, the cover 3418 defines one or more apertures 3706 that is fluidly coupled to the ambient environment to exhaust the gas 3804 flowing through the cover 3418. This advantageously prevents or inhibits the cover 3418 from vibrating when in operation. The one or more apertures 3706 may be located at the front of the cover 3418, after the discharge ports 3516, or may be located at or proximal to the back end 3708 of the cover 3418.

With brief reference back to FIG. 35, in combination with FIG. 38, to facilitate flow of the air 3804 and the transportation of the liquid 3802, the cover 3418 may include a wall 3506 projecting from an inner surface 3422 of the cover 3418. The wall 3506 divides the conduit 3420 to define a first conduit 3508 and second conduit 3510 spanning from the back end 3406 to the front end 3408 of the toilet seat 3404 on a first side 3512 and second side 3514, respectively, of the toilet seat 3404. As such, a better directional flow can be provided to assembly 3400 so as to ensure an efficient and effective movement of the liquid matter 3802 around the toilet seat 3404. When the cover 3418 includes the wall 3506, the electrical system 3424 should still cause the air 3804 to be discharged at a sufficient speed so as flow through the conduits 3508, 3510 and transport the liquid 3802 around the seat 3404.

Still referring to FIG. 35, in one embodiment the conduit 3420 is in a substantially water-tight configuration with the toilet seat 3404 when the cover 3418 is in the first position. "Substantially water-tight" is defined herein as being one object being positioned with respect to a referencing object such that a loss between any gap, break, or opening, with the exception of the discharge port(s) 3516, is less than an average of 15-20 percent of the discharged liquid per cleaning cycle. This advantageously assures the liquid matter 3802 (shown in FIGS. 37 and 38) is transported from one end of the toilet seat 3404 to another and properly and effectively clean the top surface of the toilet seat 3404. In other embodiments, the conduit 3420 is also shaped to follow a contour the inner and the outer circumferential surfaces 3412, 3414 of the toilet seat 3404 as the toilet seat 3404 spans from the back end 3406 of the toilet seat 3404 to the front end 3408 of the toilet seat 3404. The contour of the conduit 3420 can be seen in FIG. 35.

To further disinfect and/or clean the seat 3404, the assembly 3400 may include a plurality of UV lights 3806 coupled to the cover 3418 to emit, when the cover 3418 is in the first position, UV light to at least a portion of the back end 3406, first side 3512, and second side 3514 of the toilet seat 3404. The UV lights 3806 provides a further means of disinfecting the toilet seat 3404. In one embodiment, the UV light may be emitted after the discharge of the liquid 3802 and gas 3804. In other embodiments, the UV light may be emitted before the discharge of the liquid 3802 and gas 3804. As such, the UV lights 3806 are also communicatively coupled (e.g., through wired/wireless connections, microcontrollers, and/or other components) to the electrical system 3424.

With reference back to FIGS. 36 and 37, to provide user a visual indication of the assembly in operation, the upper surface 3518 of the cover 3418 is of a transparent material. The upper surface 3518 of the cover 3418 may be the outer most surface of the cover 3418 and/or the upper surface of the cover that defines the conduit 3420 (shown as first and second conduits 3508, 3510). The cover 3418 may be made of plastic, composites, or other material. This advantageously permits users to see the assembly move the disinfectant liquid 3802 around the seat 3404 via the gas 3804, and provide comfort and assurance to the user that the seat 3404 is clean.

The assembly 3400 may also include a sensor, as discussed above, coupled to the automatic cleaning toilet seat assembly

3400. The sensor is operable to detect movement of a user within a close proximity, e.g., within 6-10 ft, wherein the detection of movement causes the cover to be placed in the second position.

With reference to FIG. 39, an exemplary process flow diagram is shown depicting a method of automatically cleaning a toilet seat. The process begins at step 3900 and immediately proceeds to the step 3902 of providing a cover, a pump-like device, and fan-like device. The cover may include those features and components described above, but at least includes at least one liquid aperture and at least one gas aperture. The process continues to the step 3904 of coupling the cover to a toilet seat of a toilet. Next, step 3906 includes positioning the cover over the toilet seat to surround the toilet seat and to define a conduit spanning from a back end of the toilet seat to a front end of the toilet seat. This is also referred to herein as the "first position." The conduit provides the mean for which both a liquid and a gas is moved across and around the toilet seat to a discharge port. In other embodiment, the cover may be positioned over the toilet seat to follow a contour of an inner and an outer circumferential surface of the toilet seat as the toilet seat spans from the back end of the toilet seat to the front end of the toilet seat, as described above.

The process proceeds from step 3906 to the step 3908 of discharging a liquid matter through the at least one liquid aperture onto a portion of the toilet seat proximal to the back end of the toilet seat. This liquid may be water, used to wash the seat, or disinfectant, used to disinfect the seat. The liquid may discharge multiple instances in the cleaning cycle and may exchange between various types of liquid. The discharge of either the gas or liquid may occur using a switch, sensors, or other means discussed herein. Next, the process continues to the step 3910 of discharging a gaseous matter through the at least one gas aperture and through the conduit to transport the liquid matter from the back end of the toilet seat to the front end of the toilet seat. As such, this advantageous method provides a means to effectively and efficiently clean and sanitize a toilet seat for use by user. Automatically cleaning the toilet seat provides users ease in knowing they are not exposing themselves to undesired substances and bacteria. The process terminates in step 3912.

With reference back to FIG. 38 and as discussed above, the timing of the liquid and gas discharge may be varied based on the assembly's 3400 application and the operator's design considerations. In one preferred embodiment, fan-like device operably induces a flow in the gaseous matter 3804, initially at a point in time during a cleaning cycle (i.e., at least from a time when liquid is discharged until it is transported to the discharge port 3516 and into the toilet bowl), subsequent to when the flow of the liquid matter 3802 is initially induced. Said another way, the liquid 3802 is initially discharged before the initial discharge of the gas 3804. This not only effectively facilitates in the transportation of the liquid matter, but it also dries the top surface of the toilet seat 3404 so it is not wet when used by the user.

An automatic toilet seat assembly has been disclosed that effectively and efficiently utilizes a minimal amount of liquid matter to clean and/or sanitize a top surface of a toilet seat by transporting the liquid matter from a back end of the toilet seat to a front end of the toilet seat. The toilet seat assembly and method of use is operably carried out without human intervention and provides a quick, efficient, and effective way to clean and sanitize a toilet seat.

What is claimed is:

1. An automatic cleaning toilet seat assembly comprising:
- a toilet having a toilet seat, the toilet seat including:
  - a front end spanning from a midpoint on the toilet seat in a direction toward a front rim of the toilet;
  - a back end spanning from a toilet seat edge to the midpoint on the toilet seat;
  - a top surface; and
  - an inner and an outer circumferential surface;
- a cover:
  - having a plurality of side walls;
  - with a first position and a second position along a translation path,
    - the first position including:
      - the cover surrounding the toilet seat to define a conduit spanning from the back end of the toilet seat to the front end of the toilet seat and with a width defined by the plurality of side walls spanning approximately from the inner circumferential surface to the outer inner circumferential surface of the toilet seat; and
      - the plurality of side walls extending downwardly away from an inner surface of the cover to both the inner circumferential surface and the outer circumferential surface of the toilet seat,
    - the second position including the cover removed from above a portion of the toilet seat;
  - defining at least one liquid aperture, each of the at least one liquid aperture disposed on the cover at a location proximal to the toilet seat edge of the back end of the toilet seat and aimed to project a liquid matter in a direction from the location proximal to the toilet seat edge of the back end of the toilet seat onto the back end of the toilet seat, the at least one liquid aperture fluidly coupled, through a fluid channel, to a liquid source with a liquid matter; and
  - defining at least one gas aperture in fluid communication with the conduit and fluidly coupled, through a gas channel, to a gas source with a gaseous matter; and
- an electrical system operable, when the cover is in the first position, to cause:
  - the liquid matter to discharge onto the toilet seat through the at least one liquid aperture; and
  - the gaseous matter to discharge through the at least one gas aperture at a speed sufficient to transport the liquid matter through the conduit.

2. The automatic cleaning toilet seat assembly according to claim 1, wherein:
- the liquid matter is of at least partially a disinfectant agent.

3. The automatic cleaning toilet seat assembly according to claim 1, wherein:
- the speed of the gaseous matter is sufficient to transport the liquid matter from a portion of the toilet seat proximal to the back end of the toilet seat to the front end of the toilet seat.

4. The automatic cleaning toilet seat assembly according to claim 1, wherein:
- the at least one gas aperture is located proximal to the back end of the toilet seat.

5. The automatic cleaning toilet seat assembly according to claim 1, wherein:
- the gaseous matter is initially discharged at a point in time during a cleaning cycle subsequent to an initial discharge of the liquid matter.

6. The automatic cleaning toilet seat assembly according to claim 1, wherein the cover further comprises:
- an upper surface of a transparent material.

7. The automatic cleaning toilet seat assembly according to claim 1, wherein the electrical system is further operable to cause:

a plurality of UV lights coupled to the cover to emit, when the cover is in the first position, UV light to at least a portion of the back end, first side, and second side of the toilet seat.

8. The automatic cleaning toilet seat assembly according to claim 1, wherein the cover further comprises:

a wall projecting from an inner surface of the cover, the wall diving the conduit to define a first conduit spanning from the back end to the front end of the toilet seat on a first side of the toilet seat to define a second conduit spanning from the back end to the front end of the toilet seat on a second side of the toilet seat.

9. The automatic cleaning toilet seat assembly according to claim 8, wherein the cover further comprises:

a plurality of liquid apertures fluidly coupled, through a plurality of fluid channels, to the liquid source; and a plurality of gas apertures fluidly coupled, through a plurality of gas channels, to the gas source, wherein the electrical system is operable to cause the liquid matter to discharge through the plurality of liquid apertures onto the portion of the toilet seat proximal to the back end of the toilet seat in the first and second conduits and to cause the gaseous matter to discharge through the plurality of gas apertures at a speed in each of the first and second conduits sufficient to transport the liquid matter from the portion of the toilet seat proximal to the back end of the toilet seat to the front end of the toilet seat.

10. The automatic cleaning toilet seat assembly according to claim 1, wherein:

the conduit is in a substantially water-tight configuration with the toilet seat when the cover is in the first position.

11. The automatic cleaning toilet seat assembly according to claim 1, further comprising:

a sensor coupled to the automatic cleaning toilet seat assembly and operable to detect movement of a user within a close proximity, wherein the detection of hand movement causes the cover to be placed in the second position.

12. The automatic cleaning toilet seat assembly according to claim 1, wherein:

the conduit is shaped to follow a contour the inner and the outer circumferential surface of the toilet seat as the toilet seat spans from the back end of the toilet seat to the front end of the toilet seat.

13. The automatic cleaning toilet seat assembly according to claim 1, further comprising:

a distance separating the top surface of the toilet seat and an upper surface of the cover, wherein said distance tapers as the conduit spans from the back end of the toilet seat to the front end of the toilet seat.

14. An automatic cleaning toilet seat assembly comprising:

a cover shaped to cover a toilet seat, the cover:

having a plurality of side walls extending downwardly away from an inner surface of the cover to a point adjacent to both the inner circumferential surface and the outer circumferential surface of the toilet seat, the plurality of side walls having a width defining a conduit shaped to follow a contour an inner and an outer circumferential surface of the toilet seat as the toilet seat spans from a back end of the toilet seat to a front end of the toilet seat;

defining at least one liquid aperture fluidly coupled, through at least one liquid channel, to a liquid source with a liquid matter, each of the at least one liquid aperture disposed on the cover at a location proximal to a toilet seat edge of the back end of the toilet seat and aimed to project when the cover is in the closed position including the plurality of side walls contouring the inner and the outer circumferential surface of the toilet seat, the liquid matter through the conduit in a direction from the location proximal to the toilet seat edge of the back end of the toilet seat onto the back end of the toilet seat; and defining at least one gas aperture fluidly coupled, through at least one gas channel, to a gas source with a gaseous matter, the at least one gas aperture located proximal to the back end of the toilet seat;

an electrical system including:

a pump-like device operable to induce a flow of the liquid matter from the liquid source to the at least one liquid aperture when the cover is in the closed position; and a fan-like device operable to induce a flow of the gaseous matter from the gas source to the at least one liquid aperture when the cover is in the closed position.

15. The automatic cleaning toilet seat assembly according to claim 14, wherein the cover further comprises:

a wall projecting from an inner surface of the cover, the wall dividing the conduit to define a first conduit spanning from the back end to the front end of the toilet seat on a first side of the toilet seat and to define a second conduit spanning from the back end to the front end of the toilet seat on a second side of the toilet seat.

16. The automatic cleaning toilet seat assembly according to claim 14, wherein:

the flow of the gaseous matter is sufficient to transport the liquid matter through the conduit, from a portion of the toilet seat proximal to the back end of the toilet seat to the front end of the toilet seat.

17. The automatic cleaning toilet seat assembly according to claim 14, wherein:

the fan-like device operably induces the flow, initially at a point in time during a cleaning cycle, subsequent to when the flow of the liquid matter is initially induced.

18. A method of automatically cleaning a toilet seat, the method comprising:

providing a cover, a pump-like device, and a fan-like device, the cover:

having a plurality of side walls extending downwardly away from an inner surface of the cover to both the inner circumferential surface and the outer circumferential surface of the toilet seat;

defining at least one liquid aperture, each of the at least one liquid aperture disposed on the cover at a location proximal to a toilet seat edge of a back end of the toilet seat and aimed to project a liquid matter in a direction from the location proximal to the toilet seat edge of the back end of the toilet seat onto the back end of the toilet seat; and defining at least one gas aperture;

coupling the cover to a toilet seat of a toilet;

positioning the cover over the toilet seat to surround the toilet seat and define a conduit with spanning from a back end of the toilet seat to a front end of the toilet seat;

discharging a liquid matter through each of the at least one liquid aperture from the location proximal to the toilet seat edge of the back end of the toilet seat onto the back end of the toilet seat; and discharging a gaseous matter through the at least one gas aperture and through the conduit, and with the assistance of the plurality of side walls acting as an escape barrier of gaseous matter flowing through the conduit, to transport the liquid matter from the back end of the toilet seat to the front end of the toilet seat.

19. The method according to claim 18, further comprising: positioning the cover over the toilet seat to follow a contour of an inner and an outer circumferential surface of the toilet seat as the toilet seat spans from the back end of the toilet seat to the front end of the toilet seat.

* * * * *